US011561490B2

(12) United States Patent
Kubota

(10) Patent No.: US 11,561,490 B2
(45) Date of Patent: Jan. 24, 2023

(54) IMAGE FORMING APPARATUS

(71) Applicant: CANON KABUSHIKI KAISHA, Tokyo (JP)

(72) Inventor: Hitoshi Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/465,307

(22) Filed: Sep. 2, 2021

(65) Prior Publication Data

US 2022/0082962 A1 Mar. 17, 2022

(30) Foreign Application Priority Data

Sep. 15, 2020 (JP) ..... JP2020-155020
Jan. 29, 2021 (JP) ..... JP2021-014027

(51) Int. Cl.
*G03G 15/16* (2006.01)

(52) U.S. Cl.
CPC ..... *G03G 15/161* (2013.01)

(58) Field of Classification Search
CPC ..... G03G 15/161
See application file for complete search history.

(56) References Cited

U.S. PATENT DOCUMENTS 9,217,960 B2 12/2015 Mori et al.
9,372,445 B2 6/2016 Mori et al.
9,442,409 B2 9/2016 Hano et al.
11,022,915 B2 6/2021 Kubota et al.
2011/0150512 A1* 6/2011 Tamagaki ..... G03G 21/0094 399/53
2017/0185003 A1* 6/2017 Ohkubo ..... G03G 21/1619

FOREIGN PATENT DOCUMENTS

JP 2008-233682 A 10/2008
JP 2010-032825 A 2/2010
JP 2013-011756 A 1/2013
JP 2015-068974 A 4/2015

* cited by examiner

*Primary Examiner* — Clayton E. LaBalle
*Assistant Examiner* — Michael A Harrison
(74) *Attorney, Agent, or Firm* — Venable LLP

(57) ABSTRACT

An image forming apparatus includes an image forming portion, an intermediary transfer unit mountable in and dismountable from a main assembly and including a belt onto which the toner image is transferred from an image bearing member, a cleaning unit mountable to and dismountable from the intermediary transfer unit and including a cleaning member for cleaning a surface of the belt, a fuse provided on the cleaning unit and and being rendered non-conductible by energization, a detecting portion for detecting whether or not a current has flowed through the fuse, and a controller for controlling the image forming portion so as to carry out an operation in which, in a case that the detecting portion detects that the current has flowed through the fuse, a predetermined toner image is formed on the belt and is supplied to a contact portion between the cleaning member and the belt.

9 Claims, 17 Drawing Sheets

(a)

(b)

IMAGE FORMING APPARATUS

FIELD OF THE INVENTION AND RELATED ART

The present invention relates to an image forming apparatus, such as a copying machine, a printer, a facsimile machine, or a multi-function machine having a plurality of functions of these machines, of an electrophotographic type or an electrostatic recording type.

Conventionally, for example, as the image forming apparatus, such as the copying machine, of the electrophotographic type, there is an image forming apparatus of an intermediary transfer type in which a toner image primary transferred from a photosensitive member as an image bearing member onto an intermediary transfer member constituted by an endless belt is secondary-transferred onto a recording material. Further, in the image forming apparatus of the intermediary transfer type, deposited matter such as toner (transfer residual toner) remaining on the intermediary transfer member after the toner image is secondary-transferred from the intermediary transfer member onto the recording material is removed by a cleaning device including a cleaning member.

In the image forming apparatus of the intermediary transfer type, a lifetime of the intermediary transfer member and the cleaning device is shorter than a lifetime of an apparatus main assembly of the image forming apparatus, and therefore, the intermediary transfer member and the cleaning device are required to be exchanged as consumables in many cases. Further, a unit including the intermediary transfer member and the cleaning device is integrally made mountable in and dismountable from the apparatus main assembly in some instances.

Here, conventionally, it would be considered that in the case where the unit including the intermediary transfer member and the cleaning device is exchanged by an operator such as a user or a service person, the operator inputs information indicating the exchange to a controller of the image forming apparatus through an operating portion or the like provided in the apparatus main assembly. Further, a constitution in which on the basis of the information, the controller executes predetermined control (herein, also referred to as "initial control") in the case where a fresh (new) unit is mounted in the apparatus main assembly would be considered.

For example, as the cleaning device, a cleaning device which includes a cleaning blade contacting a member-to-be-cleaned such as the intermediary transfer member and which is used for removing the deposited matter such as the transfer residual toner from a surface of the moving member-to-be-cleaned has been widely used. The cleaning blade is formed with an elastic member such as a rubber member, and a frictional force acts on a contact portion between the cleaning blade and the member-to-be-cleaned. When this frictional force is excessively large, there is a possibility that an inconvenience such as turning-up of the cleaning blade occurs. Therefore, a method in which the toner is supplied to the contact portion between the cleaning blade and the member-to-be-cleaned and in which the frictional force at the contact portion between the cleaning blade and the member-to-be-cleaned is reduced by utilizing the toner (or an external additive thereof) as a lubricant has been known. Further, in the case where the cleaning blade is a new one, the frictional force acting on the contact portion between the cleaning blade and the member-to-be-cleaned is liable to increase in some instances.

In Japanese Laid-Open Patent Application Na 2013-11756, a constitution in which, in the case where a cartridge including an image bearing member and a cleaning blade is a new one, an amount of supply of the toner by an operation of supplying the toner to the contact portion between the cleaning blade and the member-to-be-cleaned is increased, has been proposed.

Incidentally, in the unit including the intermediary transfer member and the cleaning device, a lifetime is different between the intermediary transfer member and the cleaning device in some cases. Typically, the lifetime of the cleaning device including the cleaning blade is shorter than the lifetime of the intermediary transfer member. For this reason, when these members are exchanged as an initial unit, in order to exchange the cleaning device relatively short in lifetime, the intermediary transfer member has to be initially exchanged, thus leading to an increase in running cost of the image forming apparatus.

Therefore, in the unit including the intermediary transfer member and the cleaning device, it would be considered that the cleaning device relatively short in lifetime is further made mountable to and dismountable from another constitution including the intermediary transfer member. By this, only a necessary minimum constitution is made exchangeable, so that it becomes possible to suppress the increase in running cost of the image forming apparatus.

However, in this case, when a constitution in which an operator inputs information indicating that the unit was exchanged is employed, for example, in the case where only the cleaning device relatively short in lifetime is exchanged in the unit, there is a possibility that the operator forgets the input of the information. In that case, initial control needed to be carried out in the case where the cleaning device is exchanged with a new one is not properly executed, and thus can cause the inconvenience such as the turning-up of the cleaning blade.

SUMMARY OF THE INVENTION

A principal object of the present invention is to provide an image forming apparatus capable of reliably suppressing an occurrence of an inconvenience such as turning-up of a cleaning blade in the case where in a unit including a belt and a cleaning device, exchange of the cleaning device is enabled and the cleaning device is exchanged.

According to an aspect of the present invention, there is provided an image forming apparatus comprising: an image forming portion configured to form a toner image on an image bearing member; an intermediary transfer unit mountable in and dismountable from a main assembly and including a belt onto which the toner image is transferred from the image bearing member; a cleaning unit mountable to and dismountable from the intermediary transfer unit and including a cleaning member configured to clean a surface of the belt in contact with the belt; a fuse provided on the cleaning unit and configured to cut off conduction by energization; a detecting portion configured to detect whether or not a current flowed through the fuse; and a controller configured to control the image forming portion so as to carry out an operation in which in a case that the detecting portion detects that the current flowed through the fuse, a predetermined toner image is formed on the belt and is supplied to a contact portion between the cleaning member and the belt.

According to another aspect of the present invention, there is provided an image forming apparatus comprising: an image forming portion configured to form a toner image on an image bearing member; an intermediary transfer unit mountable in and dismountable from a main assembly and including a belt onto which the toner image is transferred from the image bearing member; a cleaning unit mountable to and dismountable from the intermediary transfer unit and including a cleaning member configured to clean a surface of the belt in contact with the belt; a memory provided on the cleaning unit and configured to store information on whether or not the cleaning unit is new one; and a controller configured to control the image forming portion so as to carry out an operation in which in a case that detection that the cleaning unit is the new one on the basis of the information of the memory, a predetermined toner image is formed on the belt and is supplied to a contact portion between the cleaning member and the belt.

Further features of the present invention will become apparent from the following description of exemplary embodiments with reference to the attached drawings.

Figure 13:
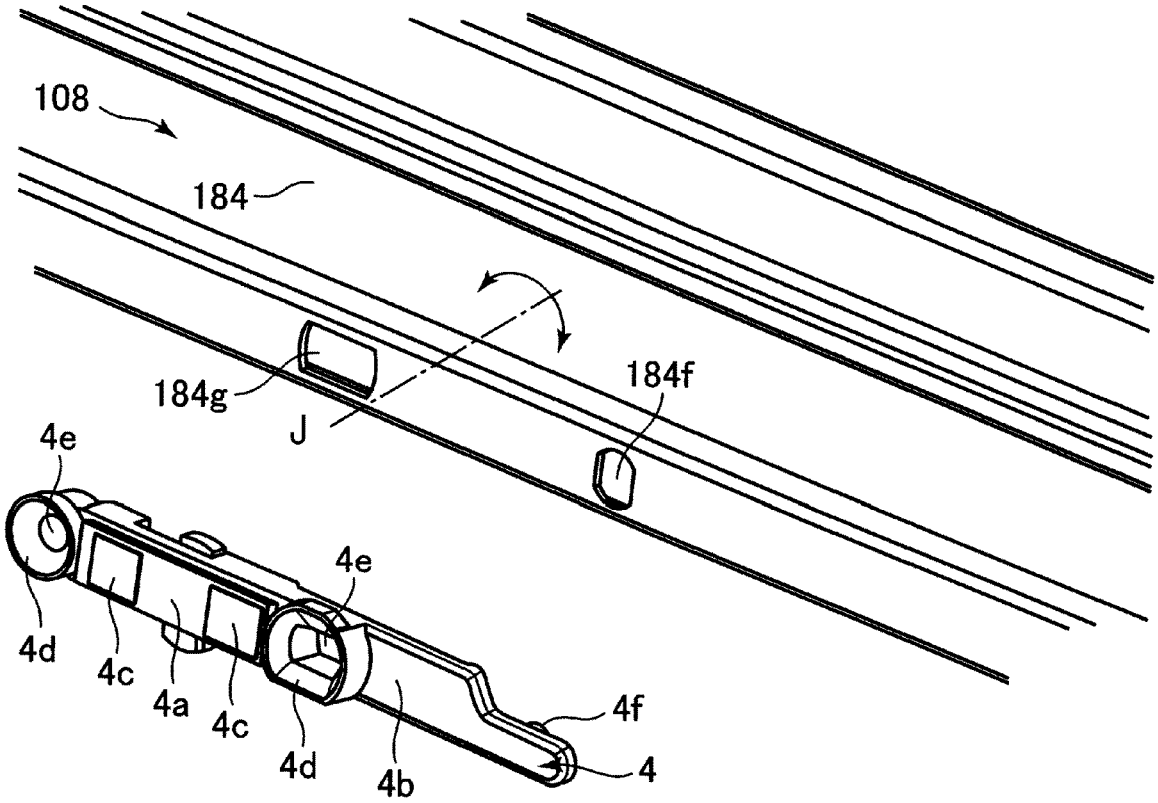
Figure 13:
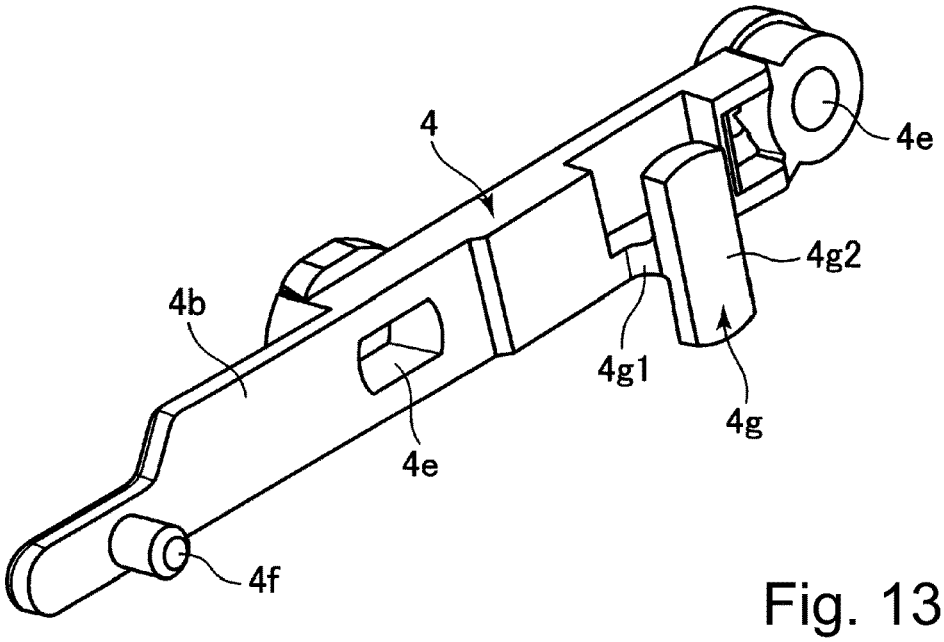

Parts (a) and (b) of FIG. 13 are perspective views for illustrating a portion-to-be-detected in the embodiment 3.

Figure 14:
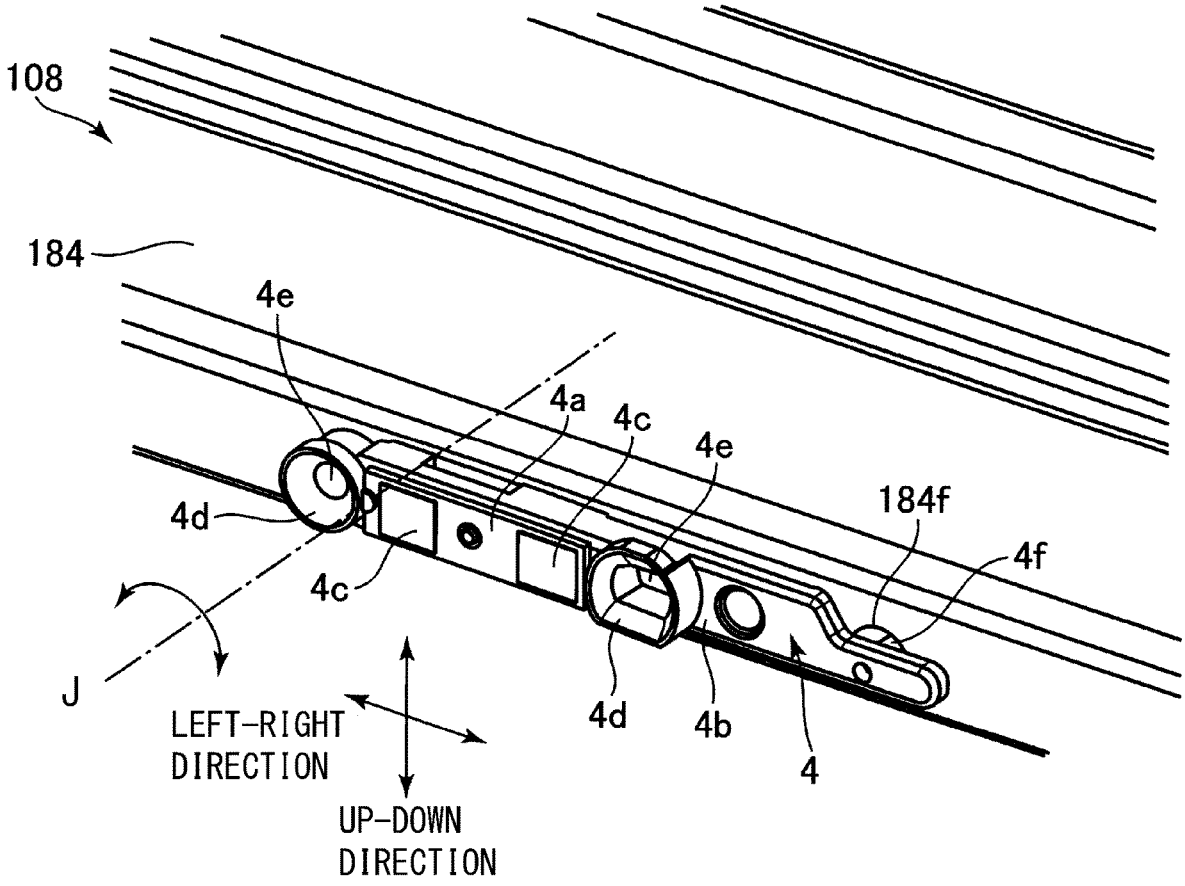

FIG. 14 is a perspective view for illustrating the portion-to-be-detected in the embodiment 3.

Figure 15:
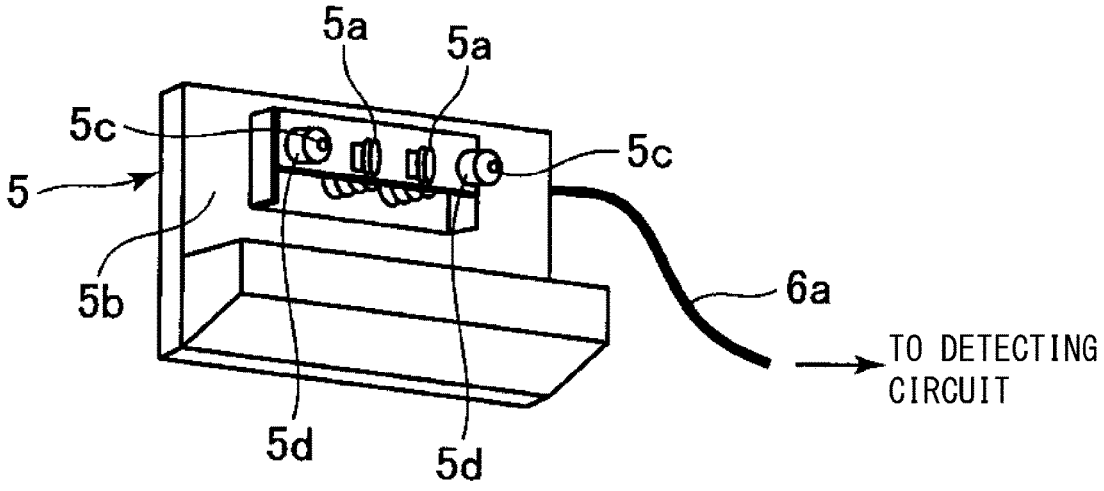

FIG. 15 is a schematic perspective view for illustrating the connecting portion in the embodiment 3.

Figure 16:
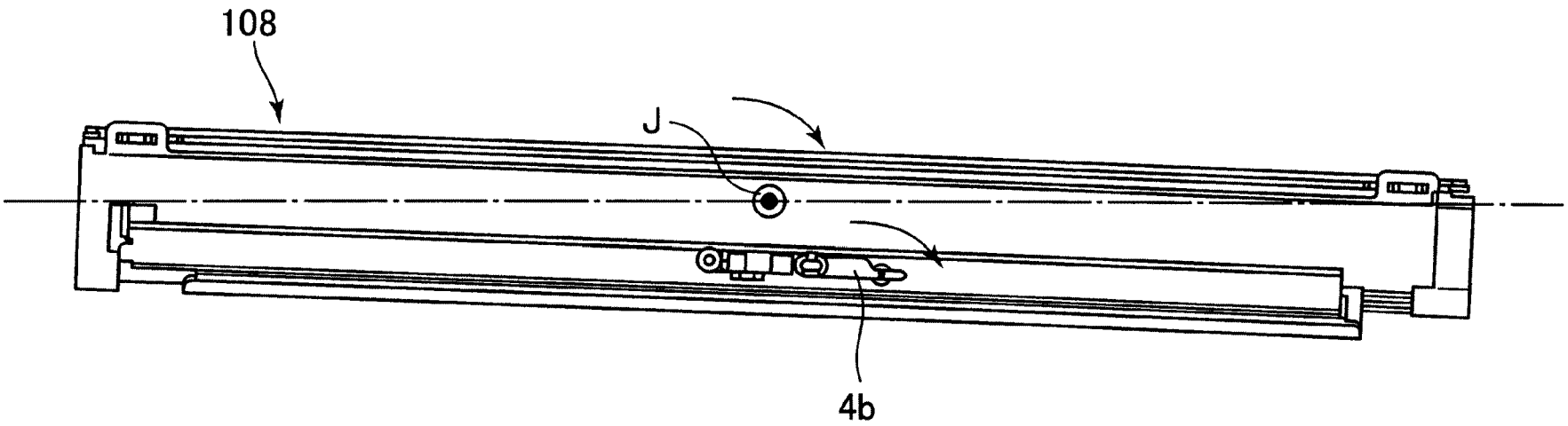

FIG. 16 is a side view for illustrating the portion-to-be-detected in the embodiment 3.

Figure 17:
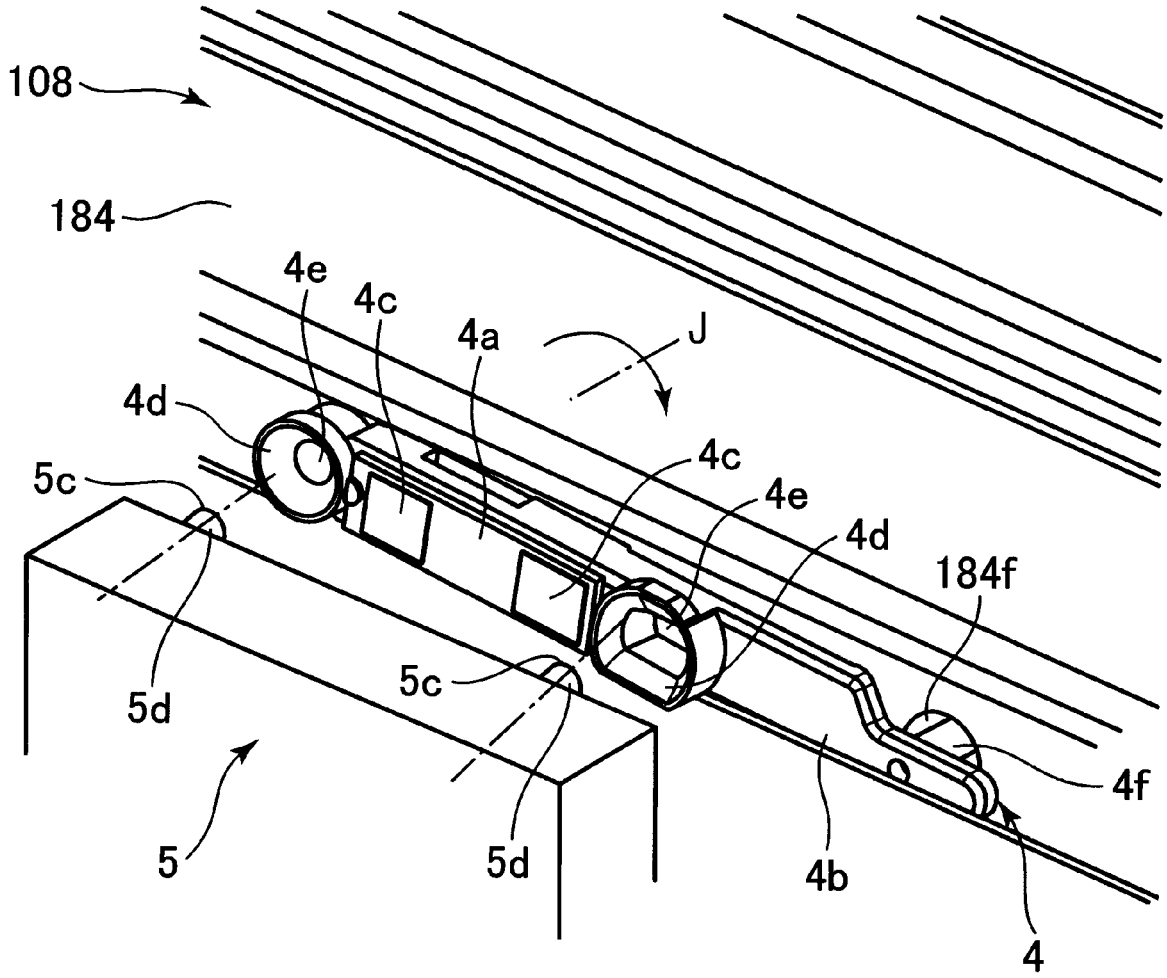

FIG. 17 is a perspective view for illustrating an operation of the portion-to-be-detected in the embodiment 1.

Figure 18:
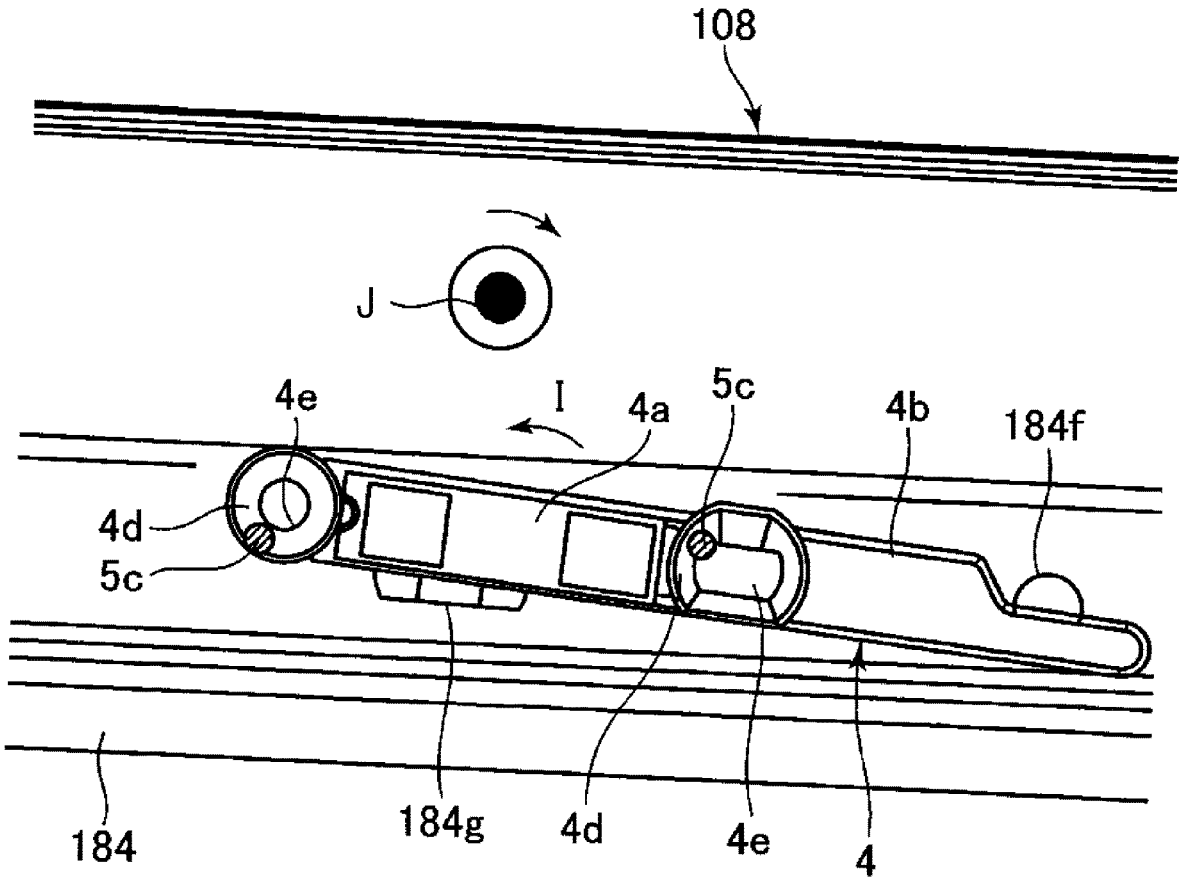

FIG. 18 are a side view for illustrating the operation of the portion-to-be-detected in the embodiment 3.

Figure 19:
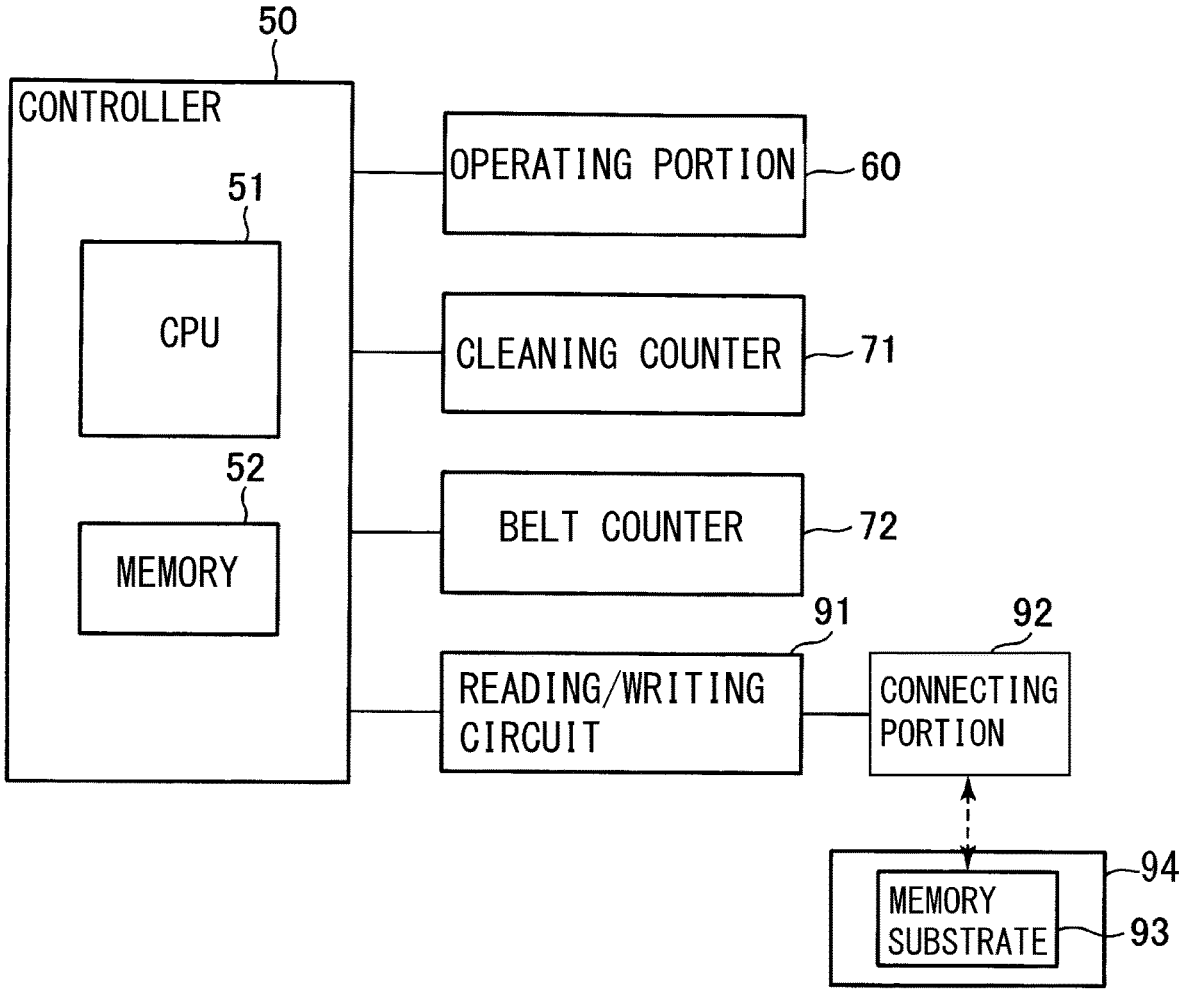

FIG. 19 is a schematic block diagram showing a control mode of a principal part of an image forming apparatus in an embodiment 4.

DESCRIPTION OF EMBODIMENTS

An image forming apparatus device according to the present invention will be described specifically with reference to the drawings.

Embodiment 1

1. General Constitution and Operation of Image Forming Apparatus

Figure 1:
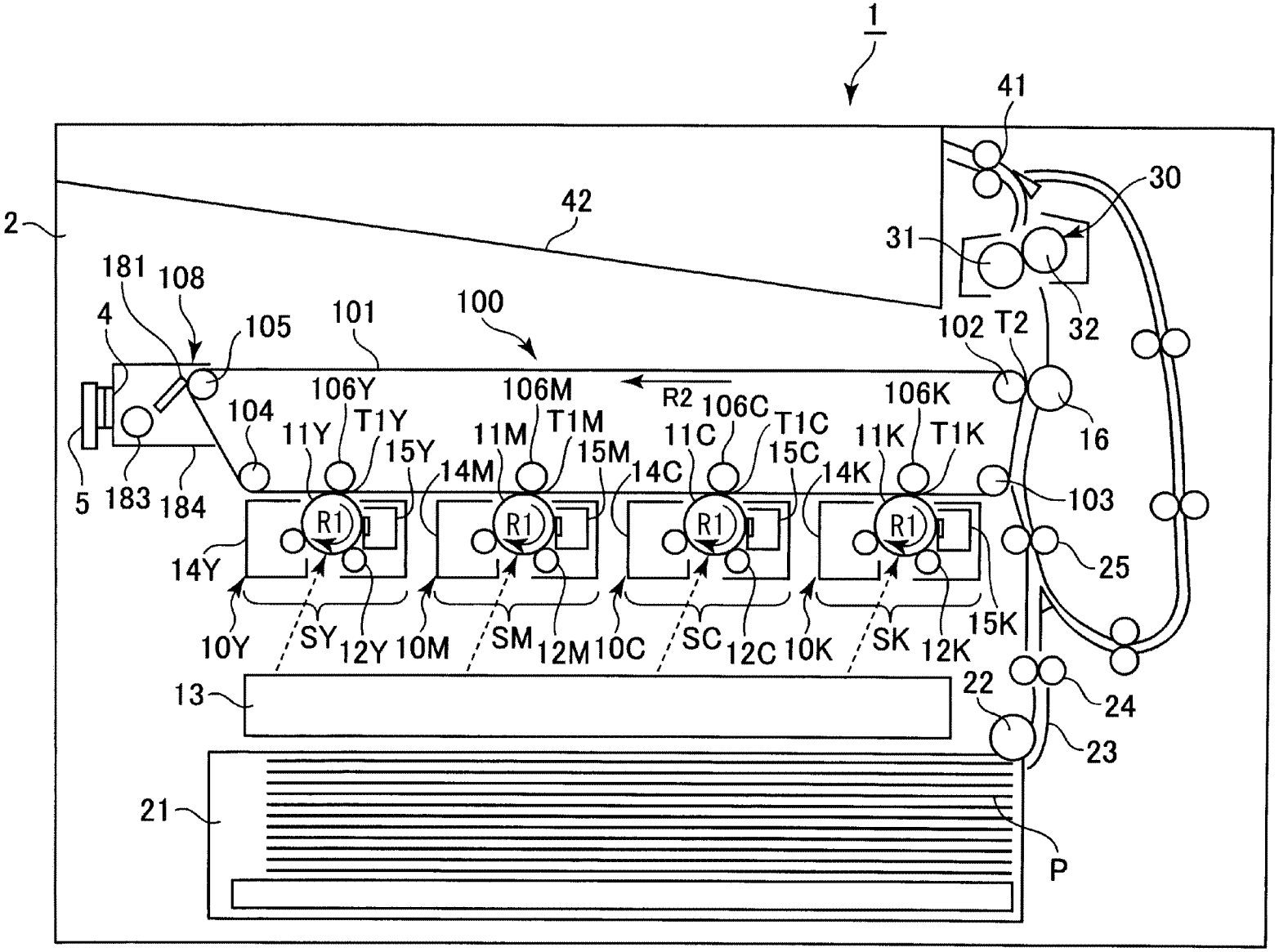
FIG. 1 is a schematic sectional view of an image forming apparatus.

FIG. 1 is a schematic sectional view of an image forming apparatus 1 according to an embodiment of the present invention. The image forming apparatus 1 of this embodiment is a tandem-type multi-function machine, which is of an electrophotographic type and is capable of forming a full-color image, which employs an intermediary transfer type system, and which has functions of a copying machine, a printer, and a facsimile machine. The image forming apparatus 1 is capable of forming an image on a sheet-like recording material P depending on an image signal sent from, for example, an external device such as a personal computer.

The image forming apparatus 1 includes, as a plurality of image forming portions, first to fourth image forming portions SY, SM, SC and SK for forming toner images of yellow (Y), magenta (M), cyan (C) and black (K), respectively. In the respective image forming portions SY, SM, SC and SK, as regards elements having the same or corresponding functions or constitutions, suffixes Y, M, C and K for representing elements for associated colors are omitted, and the elements will be collectively described in some instances. In this embodiment, the image forming portion S is constituted by including a photosensitive drum 11, a charging roller 12, an exposure device 13, a developing device 14, a primary transfer roller 16, a drum cleaning device 15, and the like, which are described later.

The photosensitive drum 11 which is a drum-shaped (cylindrical) photosensitive member (electrophotographic photosensitive member) as an image bearing member is rotationally driven in an arrow R (clockwise) direction in FIG. 1 at a predetermined peripheral speed (process speed). A surface (outer peripheral surface) of the rotating photosensitive drum 11 is electrically charged uniformly to a predetermined polarity (negative in this embodiment) and to a predetermined potential by the charging roller 12 as a charging means. The charged surface of the photosensitive drum 11 is subjected by scanning exposure to light depending on image information by the exposure device (laser scanner) 13 as an exposure means so that an electrostatic latent image (electrostatic image) is formed on the photosensitive drum 11. In this embodiment, the exposure device 13 is constituted as a single unit capable of exposing each of the photosensitive drums 11Y, 11M, 11C, and 11K to light. That is, to the exposure device 13, the image signal of each of the colors of yellow, magenta, cyan and black is sent, and depending on the image signal, the surface of each of the photosensitive drums 11 is irradiated with laser light emitted from the exposure device 13, so that electric charges are neutralized and thus the electrostatic latent image is formed. The electrostatic latent image formed on the photosensitive drum 11 is developed (visualized) with toner as a developer supplied by the developing device 14 as a developing means, so that a toner image is formed on the photosensitive drum 11. In this embodiment, on an exposure portion (image portion) on the photosensitive drum 11 lowered in absolute value of the potential through exposure after being uniformly charged, toner charged to the same charge polarity (negative in this embodiment) as the charge polarity of the photosensitive drum 11 is deposited (reverse development). In this embodiment, a normal charge polarity of the toner which is the toner charge polarity during development is negative.

An intermediary transfer belt 101 constituted by an endless belt as an intermediary transfer member is provided so as to oppose the respective photosensitive drums 11Y, 11M, 11C and 11K of the respective image forming portions SY, SM, SC and SK. The intermediary transfer belt 101 is stretched by a plurality of stretching rollers. In this embodiment, the stretching rollers include an inner pre-secondary transfer roller 102, a first auxiliary roller 103, a second auxiliary transfer roller 104 and a tension roller 105. The intermediary transfer belt 101 is driven by inputting a driving force to the inner secondary transfer roller 102 having a function of a driving roller, so that the intermediary transfer belt 107 is rotated (moved and circulated) in an arrow R2 direction (counterclockwise direction) in FIG. 1 at a peripheral speed (process speed) set substantially equal to the peripheral speed of the photosensitive drum 11. The first and secondary auxiliary rollers 103 and 104 form a substantially flat image transfer surface. The tension roller 105 imparts a predetermined tension to the intermediary transfer belt 101. Incidentally, the number of the rollers stretching the intermediary transfer belt 101 is not limited to four. On the inner peripheral surface side of the intermediary transfer belt 101, correspondingly to the respective photosensitive drums 101, primary transfer rollers 106 as primary transfer members constituting primary transfer means are provided, correspondingly to the photosensitive drums 11, respectively, between the first auxiliary roller 103 and the second auxiliary roller 104. Each of the primary transfer rollers 106 is urged (pressed) against an inner peripheral surface of the intermediary transfer belt 101 toward the associated photosensitive drum 11, By this, a primary transfer portion (primary transfer nip) T1 where the intermediary transfer belt 101 and the photosensitive drum 11 contact each other is formed. Of the plurality of stretching rollers, the stretching rollers other than the inner secondary transfer roller 102 and the respective primary transfer roller 106 are rotated with rotation of the intermediary transfer belt 101.

The toner image formed on the photosensitive drum 11 is transferred (primary-transferred) at the primary transfer portion T1 onto the rotating intermediary transfer belt 101 by applying thereto a predetermined pressing force and an electrostatic load bias. During a primary transfer step, to the primary transfer roller 106, a primary transfer voltage (primary transfer bias) which is a DC voltage of an oppose polarity (positive in this embodiment) to the normal charge polarity of the toner is applied from a primary transfer voltage source which is a high-voltage source (not shown). For example, during full-color image formation, the toner images, of the respective colors of yellow, magenta, cyan and black, formed on the respective photosensitive drums 11 are successively transferred superposedly onto the intermediary transfer belt 101. The image forming process for the respective colors which are processed in parallel by the respective image forming portions S are performed at timings each when the toner image is primary-transferred on a downstream side onto the intermediary transfer belt 101 on which the toner image has already been primary-transferred on an upstream side. Incidentally, the number of the image forming portions S is not limited to four, and the order of arrangement of the image forming portions for the respective colors is also not limited to the order of arrangement in this embodiment.

On the outer peripheral surface side of the intermediary transfer belt 101, at a position opposing the inner secondary transfer roller 102 as an opposing member, an outer secondary transfer roller 16 as a secondary transfer member constituting a secondary transfer means is provided. The outer secondary transfer roller 16 is urged (pressed) toward the inner secondary transfer roller 102 and applies an external force to the inner secondary transfer roller 102 via the intermediary transfer belt 101. By this, a secondary transfer portion (secondary transfer nip) T2 where the intermediary transfer belt 101 and the outer secondary transfer roller 106 contact each other is formed. The outer secondary transfer roller 16 is rotated by rotation of the intermediary transfer belt 101. The toner images formed on the intermediary transfer belt 101 are transferred (secondary-transferred), at the secondary transfer portion T2, onto a recording material P such as paper nipped and fed by the intermediary transfer belt 101 and the inner secondary transfer roller 16, by applying thereto a predetermined pressing force and an electrostatic load bias. During a secondary transfer step, to the outer secondary transfer roller 16, a secondary transfer voltage (secondary transfer bias) which is a DC voltage of the opposite polarity (positive in this embodiment) to the normal charge polarity of the toner is applied from a secondary transfer voltage source (not shown). The recording materials (sheets transfer materials, recording media) P are stacked and accommodated in a recording material cassette 21 as a recording material accommodating portion. The recording materials P accommodated in the recording material cassette 21 are fed one by one from the recording material cassette 21 by a feeding roller 22 and the like as a feeding means. The recording material P fed from the recording material cassette 21 is conveyed to a registration roller pair 25 as a conveying means by a conveying roller pair 24 as a conveying means through a conveying passage. This recording material P is subjected to correction of oblique movement by the registration roller pair 25 and thereafter is conveyed to the secondary transfer portion T2 by being timed to the toner images on the intermediary transfer belt 101.

The recording material P on which the toner images are transferred is conveyed to a fixing device 30 as a fixing means. The fixing device 30 heats and presses the recording material P, on which the unfixed toner images are carried, by a fixing roller 31 provided with a heat source and by a pressing roller 32 press-contacted to the fixing roller 31, so that the toner images are fixed (melted, stuck) on a surface of the recording material P. The fixing device 30 imparts a predetermined pressing force and a predetermined heat quality to the recording material P between the fixing roller 31 and the pressing roller 32. The recording material P on which the toner images are fixed is discharged (outputted) to a discharge tray 42, provided to an outside of the apparatus main assembly 2 of the image forming apparatus 1, by a discharging roller pair 41 and the like.

On the other hand, toner (primary transfer residual toner) remaining on the photosensitive drum 11 after the primary transfer step is removed and collected from the photosensitive drum 11 by a drum cleaning device 15 as a photosensitive member cleaning means.

Further, a deposited matter such as toner (secondary transfer residual toner) or paper powder remaining on the intermediary transfer belt 101 after the secondary transfer is removed and collected from the intermediary transfer belt 101 by a belt cleaning device 108 as an intermediary transfer member cleaning means. Collected matters such as the toner and paper powder collected by the belt cleaning device 108 are conveyed and collected into a residual toner collecting container (not shown) via a residual toner conveying passage (not shown).

In this embodiment, at each of the image forming portions S, the photosensitive drum 11, the charging roller 12, the developing device 14 and the drum cleaning device 15 integrally constitute a process cartridge 10 detachably mountable to the apparatus main assembly 2. Further, in this embodiment, the intermediary transfer belt 101, the stretching rollers 102 to 105, the primary transfer rollers 106, and the belt cleaning device 108 integrally constitute an intermediary transfer belt unit 100 detachably mountable to the apparatus main assembly 2. Further, in the intermediary transfer belt unit 100, the belt cleaning device 108 is further mountable to and dismountable from another constitution including the intermediary transfer belt 101. The intermediary transfer belt unit 100 will be further described later.

Incidentally, in this embodiment, the apparatus main assembly 2 corresponds to a portion other than the process cartridge 10 and the intermediary transfer belt 101 in the image forming apparatus 1.

In this embodiment, at a position of a medium stage of the apparatus main assembly 2 with respect to an up-down direction, the intermediary transfer belt unit 100 is disposed detachably mountable. The intermediary transfer belt unit 100 is supported on a supporting frame (not shown) provided in the apparatus main assembly 2 during mounting thereof into the apparatus main assembly 2. When the intermediary transfer belt unit 100 is mounted in the apparatus main assembly 2, the belt cleaning device 108 provided to the intermediary transfer belt unit 100 is connected to the residual toner feeding passage (not shown) provided in the apparatus main assembly 2. Further, in this embodiment, at a portion under the intermediary transfer belt unit 100, the four process cartridges 10Y, 10M, 10C and 10K are disposed from an upstream side toward a downstream side along a movement direction of the first transfer surface of the intermediary transfer belt 101.

2. Intermediary Transfer Belt Unit

Next, a constitution of the intermediary transfer belt unit 100 and a peripheral portion thereof in this embodiment will be further described. Here, as regards the image forming apparatus 1 and elements thereof, during the operation of the image forming apparatus 1, a front side on the drawing sheet of FIG. 1 is referred to as a "front side", and a rear side of the drawing sheet is referred to as a "rear side". A front-rear direction connecting the front side and the rear side is substantially parallel to the rotational axis direction of each of the photosensitive drum 11 and the stretching rollers 102 to 105 of the intermediary transfer belt 101 during the operation of the image forming apparatus 1. Further, as regards the image forming apparatus 1 and the elements thereof, an up-down direction refers to the up-down direction with respect to a direction of gravitation (vertical direction). However, the "up" and the "down" do not mean only "immediately above" and "immediately below", respectively, but include an "upper side" and a "lower side" with respect to a horizontal plane passing through a noted element or position.

Figure 2:
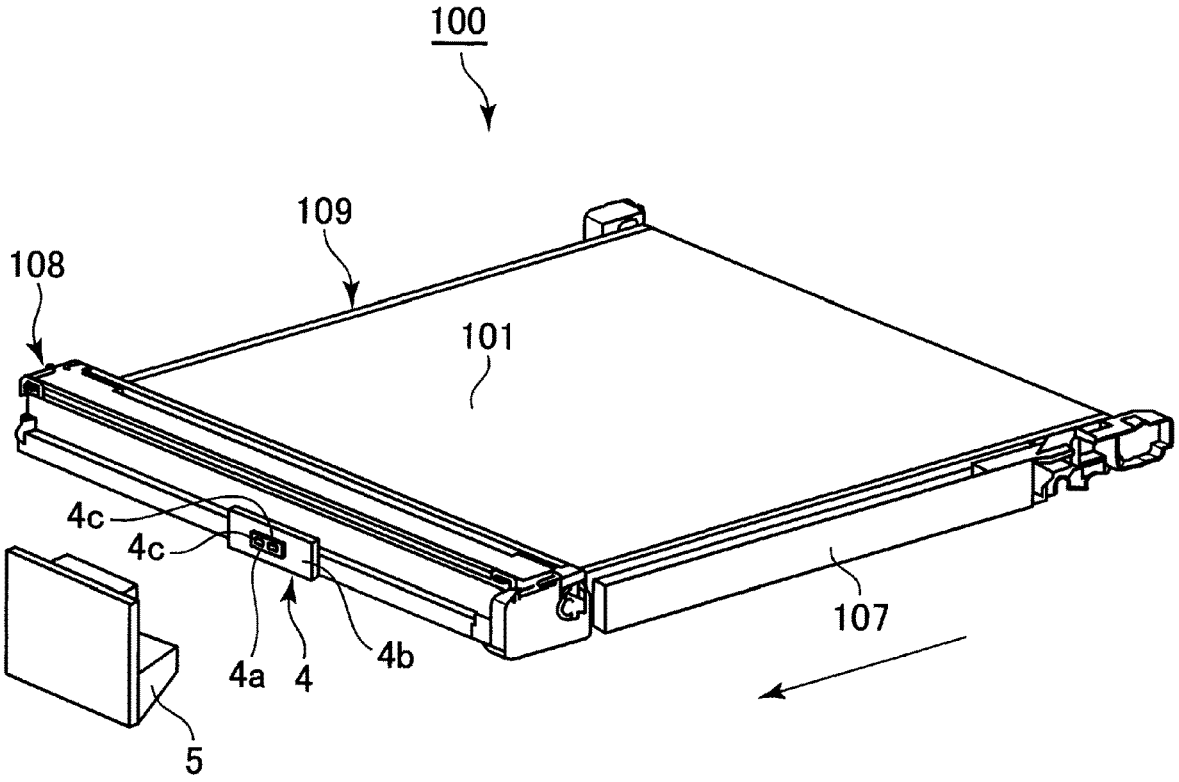
FIG. 2 is a schematic perspective view of an intermediary transfer belt unit.
Figure 3:
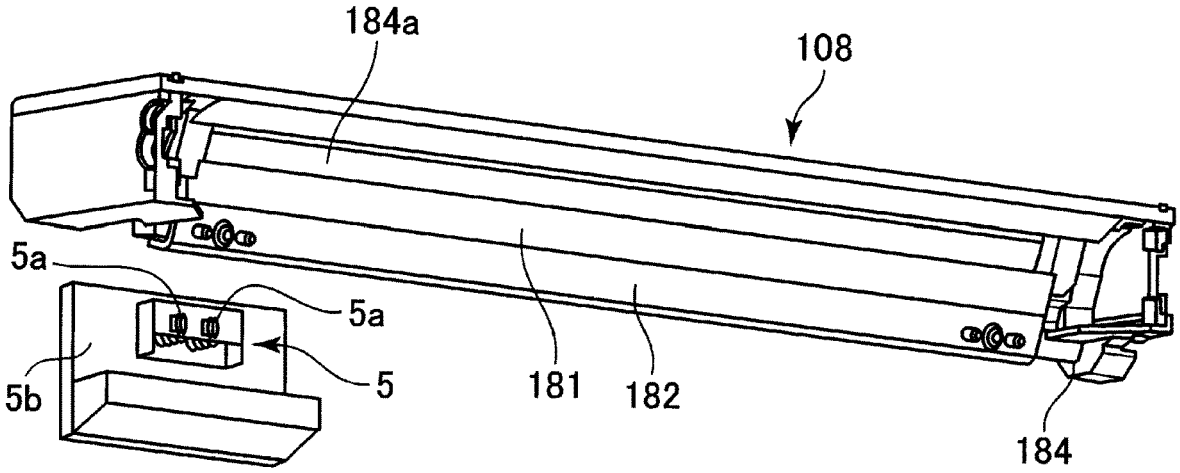
FIG. 3 is a schematic perspective view of a belt cleaning device.
Figure 4:
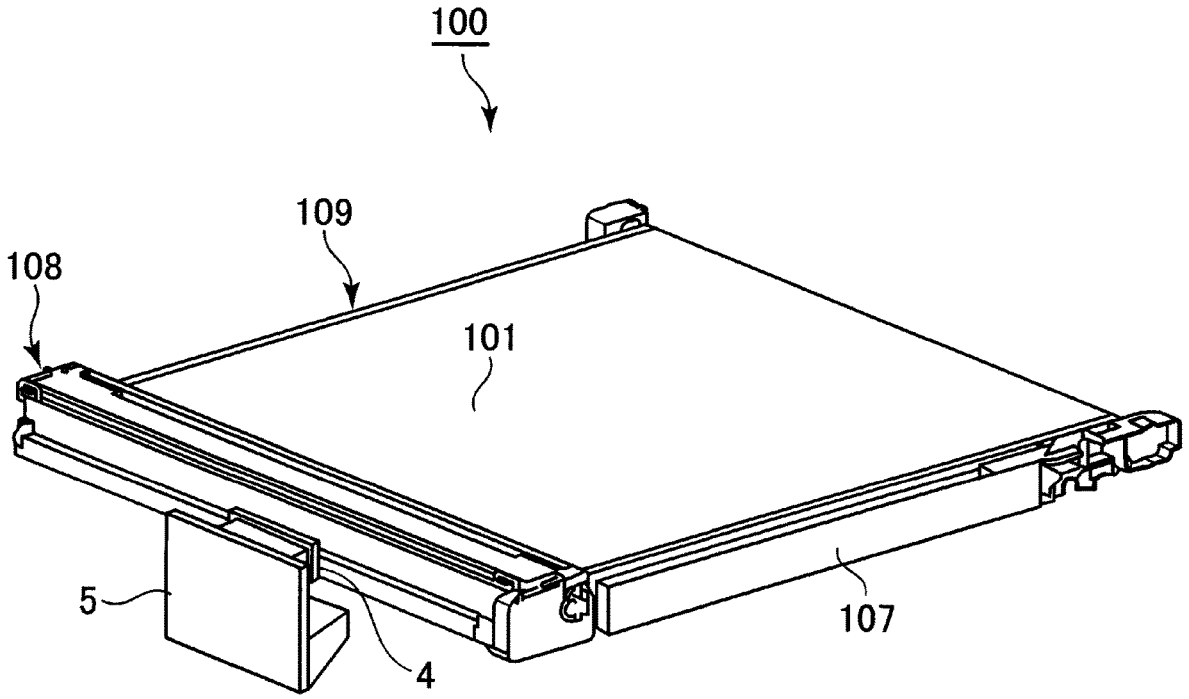
FIG. 4 is a schematic perspective view of the intermediary transfer belt unit.
Figure 5:
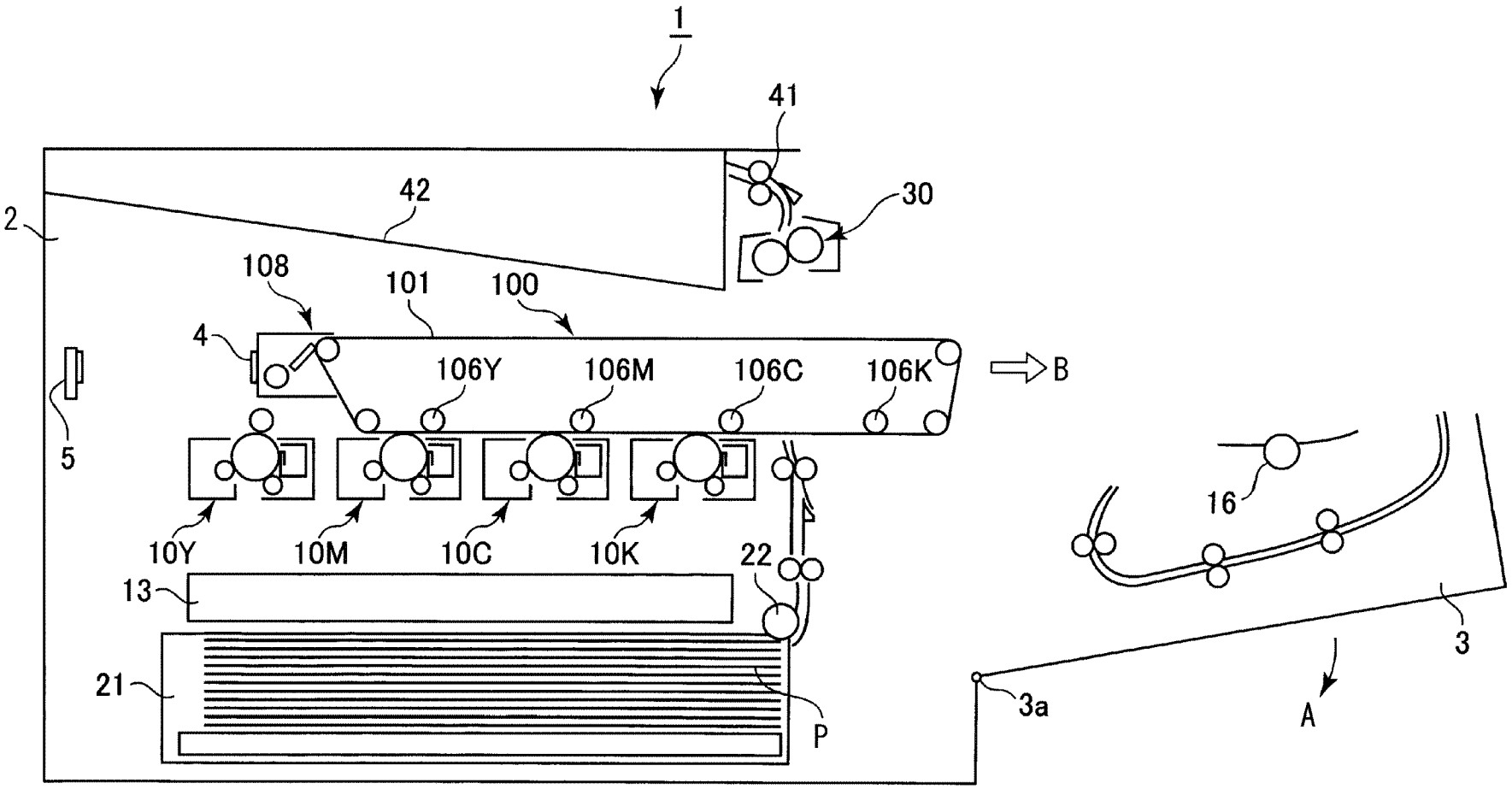
FIG. 5 is a schematic sectional view of the image forming apparatus during mounting and dismounting of the intermediary transfer belt unit.

FIG. 2 is a schematic perspective view showing the intermediary transfer belt unit 100 in a state immediately before the intermediary transfer belt unit 100 is mounted at a predetermined position in the apparatus main assembly 2 and a connecting portion 5 provided in the apparatus main assembly 2 and described later. FIG. 3 is a schematic perspective view showing the belt cleaning device 108 in a state in which the belt cleaning device 108 is dismounted from the intermediary transfer belt unit 100 and the connecting portion 5 provided in the apparatus main assembly 2. FIG. 4 is a schematic perspective view showing the intermediary transfer belt unit 100 in a state in which the intermediary transfer belt unit 100 is mounted at the predetermined position in the apparatus main assembly 2 and the connecting portion 5 provided in the apparatus main assembly 2. Further, FIG. 5 is a schematic sectional view of the image forming apparatus 1 showing a state in which the intermediary transfer belt unit 100 is mounted in and dismounted from the apparatus main assembly 2.

The intermediary transfer belt unit 100 includes a unit frame 107 and the plurality of stretching rollers 102 to 105 (FIG. 1) rotatably held by the unit frame 107. Further, the intermediary transfer belt unit 100 includes the intermediary transfer belt 101 stretched by the stretching rollers 102 to 105, the primary transfer rollers 106 (FIG. 1), and the belt cleaning device 108.

As shown in FIGS. 1 and 3, the belt cleaning device 108 includes a cleaning blade 181 as a cleaning member and a fixed metal plate 182 as a blade supporting member. Further, the belt cleaning device 108 includes a feeding screw 183 as a feeding member and a cleaning container 184 as a casing. The cleaning blade 181 is a plate-like member which has a predetermined length with respect to a longitudinal direction substantially parallel to a direction substantially perpendicular to a surface movement direction of the intermediary transfer belt 101 and with respect to a widthwise direction substantially perpendicular to the longitudinal direction, which has a predetermined thickness, and which is formed with an elastic member. In this embodiment, the cleaning blade 181 is formed with urethane rubber as the elastic member. The cleaning blade 181 is disposed opposed to the tension roller 105 via the intermediary transfer belt 101 at an angle where the cleaning blade 181 extends in a counter direction to the surface movement direction of the intermediary transfer belt 101. That is, the cleaning blade 181 is disposed so that a free end portion thereof with respect to the widthwise direction extends toward an upstream side with respect to the surface movement direction of the intermediary transfer belt 101. Further, the cleaning blade 181 is contacted to the surface of the intermediary transfer belt 101 at an edge portion of the free end portion with respect to the widthwise direction and applies an external force to the tension roller 105 via the intermediary transfer belt 101. The cleaning blade 181 is bonded and fixed to the fixed metal plate 182 at a fixed end portion thereof with respect to the widthwise direction thereof. The fixed metal plate 182, to which the cleaning blade 181 is fixed, is fixed to and held by the cleaning container 184 with screws or the like. Incidentally, as regards the belt cleaning device 108 and elements thereof, a direction substantially parallel to the longitudinal direction (the direction substantially perpendicular to the surface movement direction of the intermediary transfer belt 101) of the cleaning blade 181 is a longitudinal direction.

The collected matter such as the toner collected from the intermediary transfer belt 101 by the cleaning blade 181 is accommodated in a collected toner accommodating portion 184*a* formed in the cleaning container 184. In the collected toner accommodating portion 184*a*, a feeding screw 183 (FIG. 1) is provided. The feeding screw 183 feeds the collected toner or the like in the collected toner accommodating portion 184*a* toward one end portion (for example, the end portion on the front side) of the cleaning container 184 along the longitudinal direction of the belt cleaning device 108. Then, the collected matter such as the toner fed by the feeding screw 183 is discharged through a discharge opening (not shown) provided at the one end portion of the cleaning container 184, and is sent toward the residual toner feeding passage (not shown) provided in the apparatus main assembly 2. The collected matter sent to the residual toner feeding passage is fed to a residual toner container (not shown) detachably mounted in the apparatus main assembly 2. The residual toner container is exchanged when the residual toner container becomes full or the like.

The intermediary transfer belt unit 100 is made mountable in and dismountable from the apparatus main assembly 2. Further, in the intermediary transfer belt unit 100, the belt cleaning device 108 is made mountable to and dismountable from a belt feeding portion 109 which is another constitution including the intermediary transfer belt 101. In this embodiment, the belt feeding portion 109 includes the unit frame 107, the stretching rollers 102 to 105 (FIG. 1), the intermediary transfer belt 101, and the primary transfer rollers 106 (FIG. 1).

As shown in FIG. 5, the image forming apparatus 1 includes a right door unit 3 as an openable member, for opening an inside of the apparatus main assembly 2, provided at a side portion on the right side when the apparatus main assembly 2 is viewed from the front side. The right door unit 3 is constituted so that an upper portion thereof is rotated about a rotation shaft 3*a* provided at a lower portion thereof and extending in the front-rear direction in a manner such that the right door unit 3 is opened by rotating the upper portion thereof downward (in an arrow A direction in FIG. 5) and is closed by rotating the upper portion thereof upward (in a direction opposite to the arrow A direction in FIG. 5). The right door unit 3 is opened and closed by operating a grip portion or the like provided thereon, by an operator such as a user or a service person. The right door unit 3 is opened so that at least a part of a feeding passage of the recording material P from the recording material cassette 21 to the fixing device 30 via the secondary transfer portion T2 is divided into a front surface (onto which the toner image is transferred) side and a back surface side of the recording material P. The outer secondary transfer roller 17 is mounted on the right door unit 3 side. When the right door unit 3 is opened, the outer secondary transfer roller 16 is spaced from the intermediary transfer belt 101. When the right door unit 3 is opened, the operator has access to the intermediary transfer belt unit 100 mounted in the apparatus main assembly 2. Then, the operator is capable of dismounting the intermediary transfer belt unit 100 from the apparatus main assembly 2 by pulling out the intermediary transfer belt unit 100 toward the right side (in an arrow B direction in FIG. 5) when the apparatus main assembly 2 is viewed from the front side, by operating the grip portion or the like provided on the unit frame 107 or the like. On the other hand, the operator is capable of mounting the intermediary transfer belt unit 100 into the apparatus main assembly 2 by inserting the intermediary transfer belt unit 100 toward the left side (in a direction opposite to the arrow B direction in FIG. 5) when the apparatus main assembly 2 is viewed from the front side. Further, the operator is capable of mounting and dismounting the belt cleaning device 108 relative to the belt feeding portion 109 of the intermediary transfer belt unit 100 dismounted from the apparatus main assembly 2. The intermediary transfer belt unit 100 is mounted in and dismounted from the apparatus main assembly 2 in a state in which the belt cleaning device 108 is mounted to the belt feeding portion 109.

Incidentally, the intermediary transfer belt 101 may be exchangeable from the belt feeding portion 109 alone or may also be made exchangeable together with the belt feeding portion 109. Further, in the case where the belt cleaning device 108 and the intermediary transfer belt 101 are exchanged at the same time, these members may also be exchanged in the form of the intermediary transfer belt unit 100.

In this embodiment, a lifetime of the intermediary transfer belt 101 is shorter than a lifetime of the apparatus main assembly 2. For that reason, the intermediary transfer belt 101 is capable of being exchanged to (or with) a new one by making the intermediary transfer belt unit 100 mountable in and dismountable from the apparatus main assembly 2. Further, in this embodiment, a lifetime of the belt cleaning device 108, particularly the cleaning blade thereof is shorter than a lifetime of the apparatus main assembly 2 and the lifetime of the intermediary transfer belt 101. For that reason, the belt cleaning device 108 is made exchangeable to (or with) a new one by being made mountable to and dismountable from the belt feeding portion 109 of the intermediary transfer belt unit 100. Thus, in this embodiment, in the intermediary transfer belt unit 100, the belt cleaning device 108 shorter in lifetime than the intermediary transfer belt 101 is made mountable to and dismountable from the belt feeding portion 109. By this, only the belt cleaning device 108 in the intermediary transfer belt unit 100 is exchanged, and thus the intermediary transfer belt 101 longer in lifetime than the belt cleaning device 108 can be used continuously. Accordingly, only a minimum constitution is made exchangeable, so that it becomes possible to suppress an increase in running cost of the image forming apparatus 1.

Here, the image forming apparatus 1 of this embodiment is required to be subjected to predetermined initial control (as described later) specifically in the case where the belt cleaning device 108 is exchanged to the new one. At this time, as in the conventional constitution, when a constitution in which information to the effect that the operator exchanged the unit is inputted is employed, the operator can forget to input the information in some instances in the case where only the belt cleaning device 108 relatively short in lifetime in the intermediary transfer belt unit 100 is exchanged. In that case, the initial control required to be carried out in the case where the belt cleaning device 108 is exchanged to the new one is not properly carried out, and can cause an inconvenience such as turning-up or the like of the cleaning blade.

Therefore, in this embodiment, in the intermediary transfer belt unit 100, the belt cleaning device 108 shorter in lifetime than the intermediary transfer belt 101 is provided with a portion-to-be-detected 4 changing in state depending on whether or not the belt cleaning device 108 is the new one. Further, in this embodiment, the apparatus main assembly 2 is provided with a connecting portion 5 for detecting whether or not the belt cleaning device 108 is the new one depending on the change in state of the portion-to-be-detected 4 provided on the belt cleaning device 108.

Further, as shown in FIGS. 2 and 4, the belt cleaning device 108 is provided with the portion-to-be-detected 4. In this embodiment, the portion-to-be-detected 4 includes a fuse substrate 4*a* constituting a fuse which is capable of being electrically cut off, and includes a fuse holder 4*b* as a supporting member for holding the fuse substrate 4*a*. The fuse substrate 4*a* includes fuse contacts 4*c* and 4*cc* as contact portions connected to both terminals of the fuse. In this embodiment, the portion-to-be-detected 4 is provided on a side surface, of outer side surfaces of the cleaning container 184 of the belt cleaning device 108, positioned at a leading end of the belt cleaning device 108 with respect to a mounting direction (inserting direction) of the intermediary transfer belt unit 100 into the apparatus main assembly 2. The fuse contacts 4*c* and 4*c* of the fuse substrate 4*a* are exposed on the side surface side. In this embodiment, the fuse holder 4*b* is provided in the neighborhood of a central portion of the cleaning container 184 with respect to the longitudinal direction.

On the other hand, as shown in FIGS. 2 and 3, the apparatus main assembly 2 is provided with the connecting portion 5. The connecting portion 5 is provided at a position where the portion-to-be-detected 4 and the connecting portion 5 oppose each other in a state in which the intermediary transfer belt unit 100 is mounted in the apparatus main assembly 2. In this embodiment, the connecting portion 5 includes contact springs 5*a* and 5*a* as electrical contact portions (contact images) contactable to the fuse contacts 4*c* and 4*c*, respectively, of the fuse substrate 4*a* in the portion-to-be-detected 4, and includes a contact holder 5*b* for holding the contact springs 5*a* and 5*a*. The contact springs 5*a* and 5*a* are connected to a detecting circuit 6 (FIG. 6) as a detecting portion provided in the apparatus main assembly 2, via an electrical bundle wire (not shown) provided in the apparatus main assembly 2. The fuse substrate 4*a* of the portion-to-be-detected 4 and the connecting portion 5 are electrically connected to each other by connecting the fuse contacts 4*c* and 4*c* with the contact springs 5*a* and 5*a*, respectively. The detecting circuit 6 is capable of detecting electrical conduction or non-conduction of the fuse substrate 4*a* via the contact springs 5*a* and 5*b* and the fuse contacts 4*c* and 4*c*.

The fuse substrate 4*a* of the portion-to-be-detected 4 of the belt cleaning device 108 which is the new one is in a state in which the fuse substrate is capable of being electrically conductive. When the new belt cleaning device 108 is mounted in the apparatus main assembly 2, the fuse contacts 4*c* and 4*c* of the portion-to-be-detected 4 and the contact springs 5*a* and 5*a* of the connecting portion 5 are connected to each other, respectively. Further, when an operation (energization) of the image forming apparatus 1 is started, at a predetermined timing, energization from the detecting circuit 6 to the fuse substrate 4*a* is carried out via the contact springs 5*a* and 5*a* and the fuse contacts 4*c* and 4*c*. As a result, a current flows through the fuse substrate 4*a*, and the fuse is electrically cut off by the energization thereof. For that reason, in the case where the operation (energization) of the image forming apparatus 1 is started in a state in which the belt cleaning device 108 in which the fuse is once electrically cut off and which is not the new one is mounted in the apparatus main assembly 2, the detecting portion 6 cannot detect the electrical conduction of the fuse substrate 4*a*. That is, in this embodiment, a controller 50 (FIG. 6) is capable of detecting that the belt cleaning device 108 is the new one, specifically by detecting electrical conduction of the fuse substrate 4*a* by the detecting circuit 6.

Thus, in this embodiment, the belt cleaning device 108 is provided with the portion-to-be-detected 4 changing in state depending on whether or not the belt cleaning device 108 is the new one. Further, the apparatus main assembly 2 is provided with the connecting portion 5 for detecting the change in state of the portion-to-be-detected 4. By this, it is possible to prevent that the initial control required to be carried out in the case where the belt cleaning device 108 is exchanged to the new one is not properly carried out due to that in the case where only the belt cleaning device 108 is exchanged to the new one or in the like case, the operator forgets input of information to that effect. Accordingly, it is possible to suppress that the inconvenience such as the turning-up of the cleaning blade 181 occurs.

3. Exchange Timing

In this embodiment, the image forming apparatus 1 is capable of providing (notifying) the operator, as an index of an exchange timing of the belt cleaning device 108, a cumulative value of an index value relating to a use (operation) amount of the belt cleaning device 108 from a start of use (from a brand-new state). Further, in this embodiment, the image forming apparatus 1 is capable of providing (notifying) the operator, as an index of an exchange timing of the intermediary transfer belt 1, a cumulative value of an index value relating to a use (operation) amount of the intermediary transfer belt 1 from a start of use (from a brand-new state).

That is, in this embodiment, the image forming apparatus 1 is provided with a cleaning counter 71 (FIG. 6) as a counting means for counting the index value relating to the use amount of the belt cleaning device 108 from the start of the use of the belt cleaning device 108 and for storing a count value. Further, in this embodiment, the image forming apparatus 1 is provided with a belt counter 72 (FIG. 6) as a counting means for counting the index value relating to the use amount of the intermediary transfer belt 101 from the start of the use of the intermediary transfer belt 101 and for storing a count value. In this embodiment, as the index value relating to the use amount of the belt cleaning device 108 from the start of the use of the belt cleaning device 108, the number of sheets printed (the number of sheets subjected to image formation) in the case where a size of the sheets is converted into a predetermined size was used. Further, in this embodiment, as the index value relating to the use amount of the intermediary transfer belt 101 from the start of the use of the intermediary transfer belt 101, the number of sheets printed (the number of sheets subjected to image formation) in the case where a size of the sheets is converted into a predetermined size was used. However, these index values may only be required to be values correlating with the use amounts of the belt cleaning device 108 and the intermediary transfer belt 101, respectively, with the operation of the image forming apparatus 1. For example, a print time, a feeding distance (or the number of times of rotation) of the intermediary transfer belt 101, a feeding time (or a rotation time) of the intermediary transfer belt 101, and the like may also be used.

In this embodiment, the controller 50 (FIG. 6) of the image forming apparatus 1 causes each of the cleaning counter 71 and the belt counter 72, which are storing portions, to renew (add) the count value (number of sheets printed) and to store the renewed count value therein every time when the image is formed on the recording material P. Further, in this embodiment, when detection that the belt cleaning device 108 is the new one is made, the controller 50 causes the cleaning counter 71 to reset the count value (number of sheets printed) to an initial value (zero in this embodiment). Incidentally, in this embodiment, in the case where the intermediary transfer belt 101 is exchanged to the new one, the controller 50 causes the belt counter 72 to reset the count value (number of sheets printed) to an initial value (zero in this embodiment) depending on a predetermined operation by the operator at an operating portion 60 (FIG. 6) of the image forming apparatus 1.

Then, in this embodiment, the controller 50 is capable of causing the operating portion 60 to display the count value of the cleaning counter 71 depending on a predetermined operation by the operator at the operating portion 60. By this, the operator is capable of appropriately checking the count value (the number of sheets printed from the start of the use of the belt cleaning device 108) of the cleaning counter 71 at the operating portion 60. The operator is capable of exchanging the belt cleaning device 108 in the case where an inconvenience such as contamination of the image by improper cleaning occurs or in the case where the operator checks the count value of the cleaning counter 71 and the count value exceeds a predetermined lifetime value set in advance, or in the like case. In this embodiment, an index of the lifetime of the belt cleaning device 108 is set at 200,000 sheets in terms of the number of sheets printed (the count value of the cleaning counter 71).

Similarly, in this embodiment, the controller 50 is capable of causing the operating portion 60 to display the count value of the belt counter 72 depending on a predetermined operation by the operator at the operating portion 60. By this, the operator is capable of appropriately checking the count value (the number of sheets printed from the start of the use of the intermediary transfer belt 101) of the belt counter 72 at the operating portion 60. The operator is capable of exchanging the intermediary transfer belt 101 in the case where an inconvenience such as an image defect due to deterioration of the intermediary transfer belt 101 occurs or in the case where the operator checks the count value of the belt counter 72 and the count value exceeds a predetermined lifetime value set in advance, or in the like case. In this embodiment, an index of the lifetime of the intermediary transfer belt 101 is set at 500,000 sheets in terms of the number of sheets printed (the count value of the belt counter 72).

Incidentally, on the basis of the count value of the cleaning counter 71, the image forming apparatus 1 may also automatically notify (by displaying or the like) the operator of information prompting the operator to exchange the belt cleaning device 108 at the operating portion 60 (or a display portion of the external device). For example, in the case where the controller 50 compares the count value of the cleaning counter 71 with a predetermined threshold, set in advance, indicating the lifetime of the belt cleaning device 108 and then discriminates that the count value exceeds the threshold, the controller 50 is capable of notifying the operator of the above-described information at the operating portion 60 or the like.

Similarly, on the basis of the count value of the belt counter 72, the image forming apparatus 1 may also automatically notify (by displaying or the like) the operator of information prompting the operator to exchange the intermediary transfer belt 101 at the operating portion 60 (or a display portion of the external device). For example, in the case where the controller 50 compares the count value of the belt counter 72 with a predetermined threshold, set in advance, indicating the lifetime of the intermediary transfer belt 101 and then discriminates that the count value exceeds the threshold, the controller 50 is capable of notifying the operator of the above-described information at the operating portion 60 or the like.

4. Initial Control

The cleaning blade 181 contacts the intermediary transfer belt 101 at an edge portion of a free end portion thereof. The cleaning blade 181 is formed with an elastic member, and abrasion of the cleaning blade 181 advances at the edge portion of the free end portion of the cleaning blade 181 when the number of sheets printed from the start of the use of the belt cleaning device 108 exceeds a predetermined value. As a result, there is a possibility that power of removing the deposited matter such as the transfer residual toner on the intermediary transfer belt 101 lowers and thus a print image is contaminated. For that reason, the operator such as the user or the service person is capable of exchanging the belt cleaning device 108 by checking the first contamination or the number of sheets printed as described above. Further, in this embodiment, the controller 50 (FIG. 6) of the image forming apparatus 1 carries out control so as to execute predetermined initial control in the case where on the basis of a signal from the detecting circuit 6, detection that the belt cleaning device 108 is exchanged to the new one is made.

In this embodiment, the controller 50 carries out, as the initial control, control in which the toner is supplied as a lubricant, to a contact portion between the cleaning blade 181 and the intermediary transfer belt 101 (herein, this control is also referred to as "supply control"). This is because a frictional force acting on the contact portion between the cleaning blade 181 and the intermediary transfer belt 101 is larger in the case where the cleaning blade 181 is a new one than in the case where the cleaning blade 181 is not the new one in some instances. When the frictional force acting on the contact portion between the new cleaning blade 181 and the intermediary transfer belt 101 becomes excessively large, there is a possibility that the inconvenience such as the turning-up of the cleaning blade 181 occurs.

In this embodiment, the supply control is carried out in the following manner. In the case where detection that the belt cleaning device 108 is mounted in the apparatus main assembly 2 is made, thereafter before a first printing operation is performed, the controller 50 carries out the supply control of supplying the toner to the contact portion between the cleaning blade 181 and the intermediary transfer belt 101. In the supply control, in at least one of the plurality of image forming portions S, a band-like or line-like predetermined toner image extending along a direction (main scan direction) substantially perpendicular to the surface movement direction of the photosensitive drum 11 (and the intermediary transfer belt 101) is formed on the photosensitive drum 11. Herein, this predetermined toner image is also referred to as a "supply toner image". In this embodiment, the supply toner image is formed through the charging step, the exposure step, and the developing step in a process similar to the above-described process during the normal image formation. The supply toner image formed on the photosensitive drum 11 is transferred onto the intermediary transfer belt 101 at the primary transfer portion T1. The supply toner image transferred on the intermediary transfer belt 101 is supplied to the contact portion between the cleaning blade 181 and the intermediary transfer belt 101 by rotation of the intermediary transfer belt 101. Incidentally, when the supply toner image passes through the secondary transfer portion T2, to the outer secondary transfer roller 16, a voltage of the same polarity (opposite to the polarity during the secondary transfer) as the normal charge polarity of the toner is applied, so that deposition of the supply toner image on the outer secondary transfer roller 16 is suppressed. Or, a means for spacing (separating) the outer secondary transfer roller 16 from the intermediary transfer belt 101 when the supply toner image passes through the secondary transfer portion T2 may also be provided. In this embodiment, the supply toner image is the band-like or line-like toner image extending over a substantially entire image formable region with respect to a direction substantially perpendicular to the surface movement direction of the photosensitive drum 11 (and the intermediary transfer belt 101). However, this toner image may also be a single toner image or a plurality of toner images formed in an arbitrary length with respect to the direction substantially perpendicular to the surface movement direction of the photosensitive drum 11 (and the intermediary transfer belt 101). For example, the supply toner image is the band-like toner image which has a length ranging over the substantially entire image formable region with respect to the above-described substantially perpendicular direction and which has a length of 10 mm with respect to a direction (sub-scan direction) substantially parallel to the surface movement direction of the photosensitive drum 11 (and the intermediary transfer belt 101). Further, in this embodiment, a density of this supply toner image is at FFH (maximum density level (solid image) of 256 levels from 0 to 255). In the supply control, by utilizing a lubricating property of the toner (or an external additive thereof) supplied to the contact portion between the cleaning blade 181 and the intermediary transfer belt 101, it is possible to reduce the frictional force acting on the contact portion between the cleaning blade 181 and the intermediary transfer belt 101. By this, it is possible to suppress that the inconvenience such as the turning-up of the cleaning blade 181 occurs.

On the other hand, in this embodiment, in the case where the operation (energization) of the image forming apparatus 1 is started in a state in which the belt cleaning device 108 which is not the new one is mounted in the apparatus main assembly 2, and thereafter before a first printing operation is performed, the supplying operation is not executed. For example, such a case includes the case where the belt cleaning device 108 which is not the new one is re-mounted in the apparatus main assembly 2 or includes the case where a main switch (power source) of the image forming apparatus 1 is turned on in the state in which the belt cleaning device 108 which is not the new one is mounted in the apparatus main assembly 2.

Incidentally, in this embodiment, the initial control is the supply control executed after the new belt cleaning device 108 is mounted in the apparatus main assembly 2 and before the first printing operation is performed, but the present invention is not limited to such a constitution. For example, the supply control is repetitively executed after the use of the belt cleaning device 108 is started, for example, at a predetermined timing such as every predetermined number of sheets printed during non-image formation, in some instances. At this time, in a predetermined period in which a use amount of the cleaning blade 181 from the start of the use is relatively small, the frictional force acting on the contact portion between the cleaning blade 181 and the intermediary transfer belt 101 is liable to become larger than a frictional force after the predetermined period in some instances. In such a case, in the supply control executed as the initial control during the predetermined period after the belt cleaning device 108 is mounted in the apparatus main assembly 2, a toner amount of the supply toner image can be made larger than a toner amount of the supply toner image in the supply control executed after the predetermined period. The predetermined period is, for example, a period from a start of use to the number of sheets printed of 50,000 sheets in the case where the lifetime of the belt cleaning device 108 is set at 200,000 sheets. The toner amount of the supply toner image can be made large, for example, in the following manner. That is, the toner amount can be increased by increasing at least one of the length (width) of the supply toner image with respect to the sub-scan direction and the length of the supply toner image with respect to the main scan direction. Further, the density of the supply toner image can be increased. Further, the number of times of the supply control (an execution frequency of supply control) executed per unit number of sheets printed can be increased.

5. Control Mode

Figure 6:
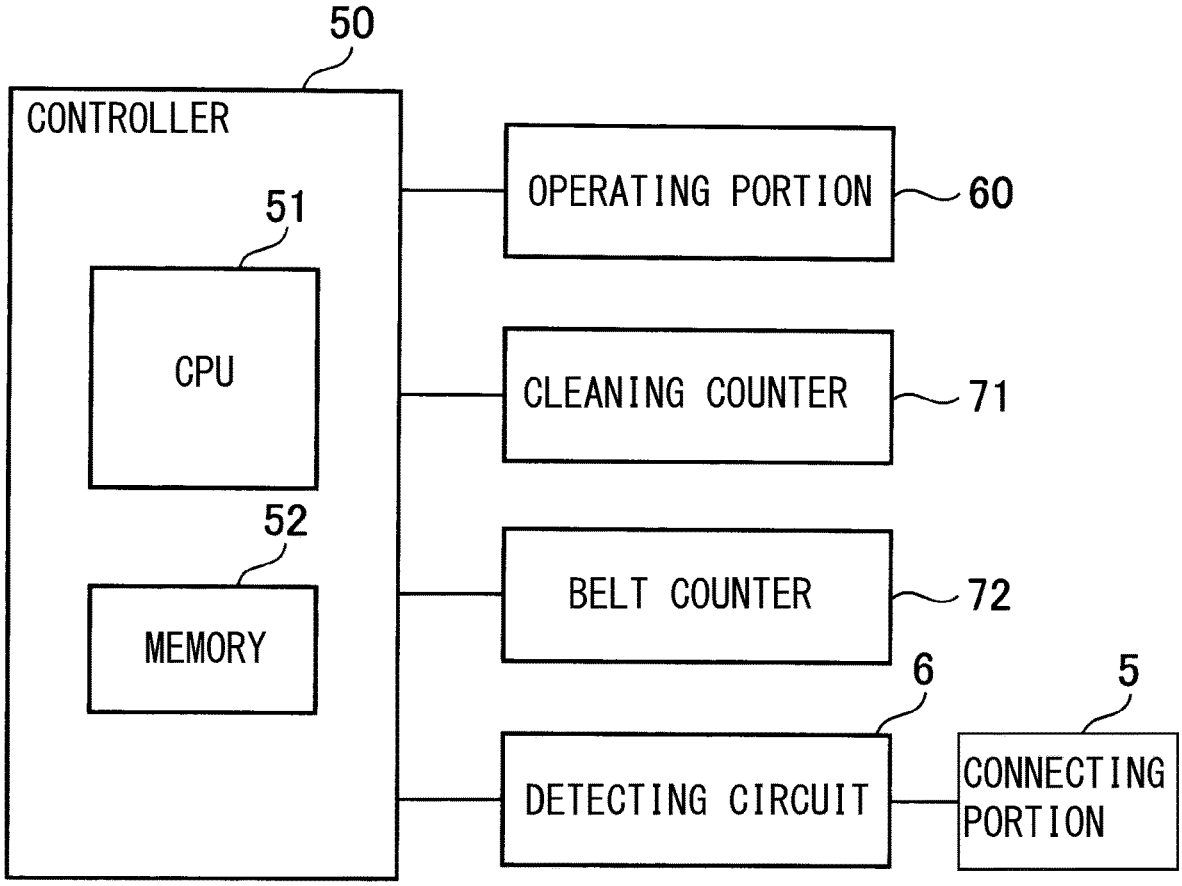
FIG. 6 is a schematic block diagram showing a control mode of a principal part of the image forming apparatus.

FIG. 6 is a schematic block diagram showing a control mode of a principal part of the image forming apparatus 1 in this embodiment. The image forming apparatus 1 is provided with the controller 50. The controller 50 is constituted by including a CPU 51 as an arithmetic control means which is a dominant element for performing processing, memories (storing media) 52 such as a ROM and a RAM which are used as storing means, and interface portions (input (output circuits) (not shown). In the RAM, which is a rewritable memory, information inputted to the controller 50, detected information, a calculation result and the like are stored. In the ROM, a data table acquired in advance and the like are stored. The CPU 51 and the memories 52 are capable of transferring and reading the data therebetween. The interface portions control input and output (communication) of signals between the controller 50 and equipment connected to the controller 50. To the controller 50, the respective portions (the image forming portions S, the intermediary transfer belt 101, the driving devices, various power sources, various sensors and the like for members relating to feeding of the recording material P) of the image forming apparatus 1 are connected. In this embodiment, to the controller 50, the detecting circuit 6 for detecting whether or not the belt cleaning device 108 is the new one is connected. The detecting circuit 6 is capable of detecting electrical conduction or non-conduction of the fuse substrate 4*a* by carrying out energization to the fuse substrate 4*a* provided on the belt cleaning device 108 as described above. A signal indicating a detection result of the detecting circuit 6 is inputted to the controller 50. On the basis of the signal from the detecting circuit 6, the controller 50 is capable of detecting whether or not the belt cleaning device 108 is the new one (in this embodiment, specifically detecting that the belt cleaning device 108 is the new one). Further, to the controller 50, the operating portion (operating panel, operating screen) 60 provided on the image forming apparatus 1 is connected. The operating portion 60 includes a display portion (display means) for displaying information by control of the controller 50 and includes an input portion (input means) for inputting information to the controller 50 through an operation by the operator such as the user or the service person. The operating portion 60 may also be constituted by including a touch panel having functions of the display means and the input means. Further, to the controller 50, an image reading device (not shown) provided on the image forming apparatus 1 or connected to the image forming apparatus 1 and an external device (not shown) such as a personal computer connected to the image forming apparatus 1 may also be connected.

The image forming apparatus executes a job, which is a series of operations, which is started by a single start instruction and in which the image is formed and outputted on a single recording material P or a plurality of recording materials P. The job includes an image forming step (image forming operation, printing operation, print operation), a pre-rotation step, a sheet (paper) interval step in the case where the images are formed on the plurality of recording materials P, and a post-rotation step, in general. The image forming step is performed in a period in which formation of an electrostatic image for the image actually formed and outputted on the recording material P, formation of the toner image primary transfer of the toner image and secondary transfer of the toner image are carried out, in general. Specifically, a timing during the image formation is different among positions where the respective steps of the formation of the electrostatic image, the toner image formation, the primary transfer of the toner image and the secondary transfer of the toner image are performed. The pre-rotation step is performed in a period in which a preparatory operation, before the image forming step, from an input of the start instruction until the image is started to be actually formed, is performed. The sheet interval step is performed in a period corresponding to an interval between a recording material P and a subsequent recording material P when the images are continuously formed on a plurality of recording materials P (continuous image formation). The post-rotation step is performed in a period in which a post-operation (preparatory operation) after the image forming step is performed. During non-image formation (non-image formation period) is a period other than the period of the image formation and includes the periods of the pre-rotation step, the sheet interval step, and the post-rotation step and further includes a period of a pre-multi-rotation step which is a preparatory operation during turning-on of a main switch (voltage source) of the image forming apparatus 100 or during restoration from a sleep state.

The controller 50 controls the respective portions of the image forming apparatus 1 on the basis of information of the job and causes the respective portions to perform the image forming operation. The information of the job includes a start instruction (start signal) inputted from the operating portion 60 and the external device, information (instruction signal) on an image forming condition such as a kind of the recording material P, and first information (first signal) inputted from the image reading device and the external device. Further, the controller 50 is capable of executing the above-described initial control during the non-image formation in the case where the new belt cleaning device 108 is mounted in the apparatus main assembly 2.

6. Processing Procedure

Figure 7:
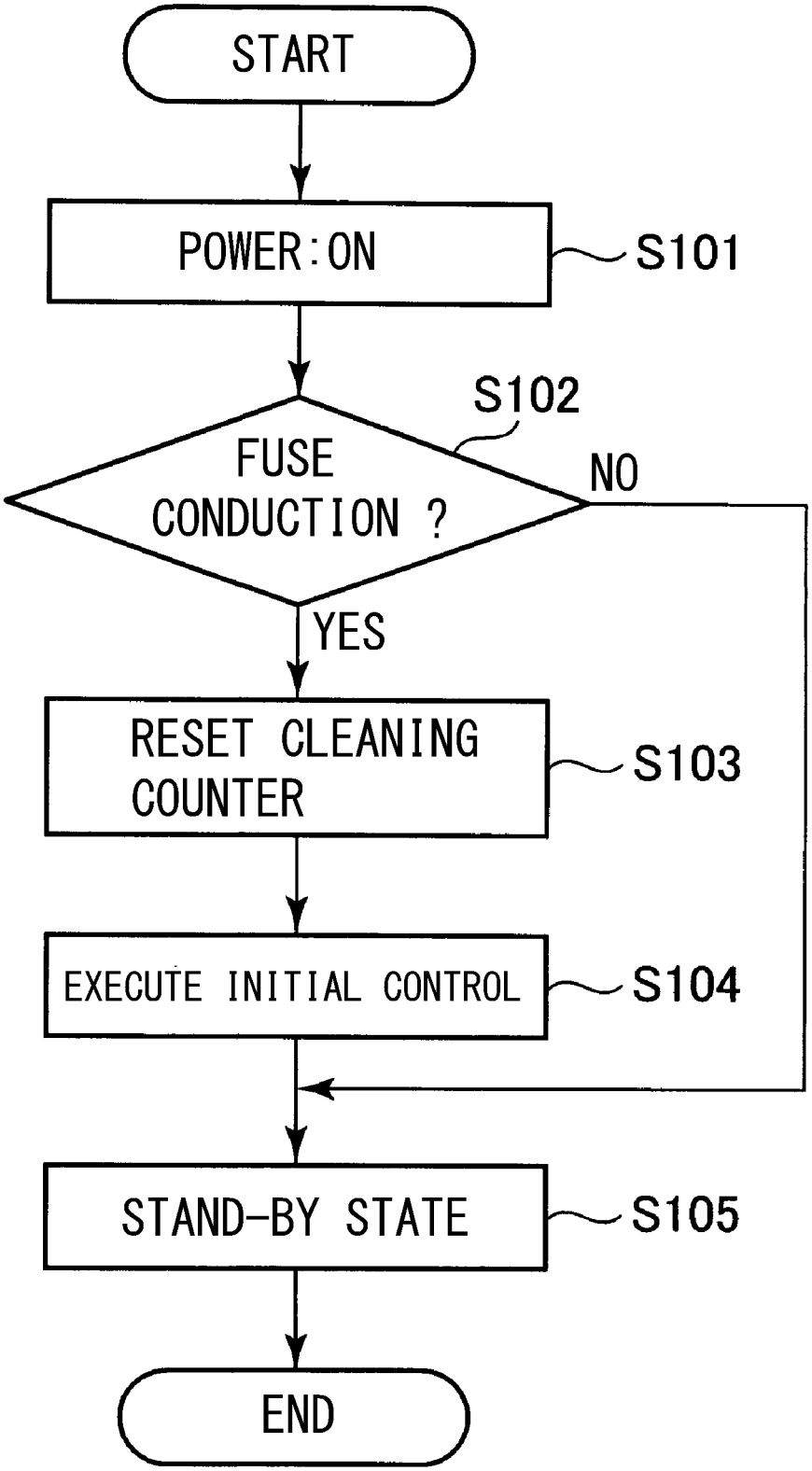
FIG. 7 is a flowchart showing a process during mounting of the intermediary transfer belt unit.

Next, processing in this embodiment when the intermediary transfer belt unit 100 is mounted in the apparatus main assembly 2 will be further described. FIG. 7 is a flow chart showing an outline of a procedure of the processing.

In the case where the belt cleaning device 108 is exchanged, as shown in FIGS. 2 and 5, the operator integrally dismounts, from the apparatus main assembly 2, the intermediary transfer belt unit 100 in a state in which the belt cleaning device 108 is mounted in the apparatus main assembly 2. Then, the operator further dismounts only the belt cleaning device 108 from the belt feeding portion 109 of the dismounted intermediary transfer belt unit 100. Thereafter, the operator mounts a brand-new belt cleaning device 108 to the belt feeding portion 109. Then, the operator integrally inserts, into the apparatus main assembly 2, the intermediary transfer belt unit 100 to which the new belt cleaning device 108 is mounted. When the intermediary transfer belt unit 100 is inserted into the apparatus main assembly 2, as shown in FIG. 4, the intermediary transfer belt unit 100 reaches a predetermined position in the apparatus main assembly 2. Then, the fuse substrate 4*a* of the portion-to-be-detected 4 provided on the belt cleaning device 8 and the connecting portion 5 provided in the apparatus main assembly 2 are electrically connected to each other by contact of the fuse contacts 4*c* and 4*c* with the contact springs 5*a* and 5*a*, respectively. In this embodiment, the image forming apparatus 1 is constituted so that when the intermediary transfer belt unit 100 is dismounted from the apparatus main assembly 2, the main switch (power source) of the image forming apparatus 1 is turned off. At this time, the power source of the image forming apparatus 1 may be turned off by operating the main switch by the operator or may also be turned off by the controller 50 on the basis of detection of opening of the right door unit 3 by an open/close sensor (not shown).

Referring to FIG. 7, when the intermediary transfer belt unit 100 is mounted in the apparatus main assembly 2 and the power source of the image forming apparatus 1 is put in an ON state (S101), the controller 50 checks the conduction of the fuse substrate 4*a* at a predetermined timing before a subsequent first printing operation is performed (S102). That is, the controller 50 carries out the energization to the fuse substrate 4*a* via the connecting portion 5 by the detecting circuit 6, and discriminates whether or not a signal indicating that the conduction of the fuse substrate 4*a* is detected is acquired from the detecting circuit 6. At this time, the power source of the image forming apparatus 1 may be turned on through the operation of the main switch by the operator and may also be turned on by the controller 50 on the basis of detection, by the open/close sensor (not shown), that the right door unit 3 is closed. Further, at this time, in the case where the belt cleaning device 108 is the new one, the current flows through the fuse substrate 4 and then the fuse is electrically cut off (blown out) by energization thereof. In S102, in the case where a signal indicating that the conduction of the fuse substrate 4*a* is confirmed is acquired from the detecting circuit 6, the controller 50 is capable of discriminating that the belt cleaning device 108 was exchanged to the new one. On the other hand, in S102, in the case where the signal indicating that the conduction of the fuse substrate 4*a* is confirmed is not acquired from the detecting circuit 6, the controller 50 is capable of discriminating that the belt cleaning device 108 is not new one.

Then, the controller 50 resets the cleaning counter 71 to an initial value in the case where the belt cleaning device 108 is the new one in S102 (S103), and then executes the above-described supply control as the initial control (S104). Thereafter, the controller 50 causes the image forming apparatus 1 to be put in a stand-by state in which the image forming apparatus 1 waits for a job, and executes the job in the case where information on the job is inputted (S105). Further, in the case where the belt cleaning device 108 is not the new one in S102, the controller 50 causes the processing to go to S105.

As described above, in this embodiment, the image forming apparatus 1 includes the unit 100 which includes the intermediary transfer member 101, the cleaning member 181 contacting the intermediary transfer member 101, and the cleaning device 108 for cleaning the intermediary transfer member 101 and which is integrally mountable in and dismountable from the apparatus main assembly 2. As regards this unit 100, the cleaning device 108 is detachably mountable to this unit 100. Further, in this embodiment, the image forming apparatus 1 includes the fuse 4*a* which is provided on the cleaning device 108 and of which conduction is cut off by energization, and includes the electrical connecting portion 5*a* which is provided so as to be electrically connectable to the fuse 4*a* when the unit 100 in which the cleaning device 108 is mounted is mounted to the apparatus main assembly 2 and which is capable of energization to the fuse 4*a*. Further, in this embodiment, the image forming apparatus 1 includes the controller 50 for controlling the energization to the fuse 4*a* so that conduction of the fuse 4*a* is cut off by performing the energization to the fuse 4*a* before first image formation using the unit 100 is carried out in the case where the unit 100 is mounted in the apparatus main assembly 2. Further, in this embodiment, the image forming apparatus 1 includes the detecting portion 6 for detecting whether or not the current flowed through the fuse 4*a*.

Further, according to this embodiment, in the intermediary transfer belt unit 100, only the belt cleaning device 108 can be exchanged. For that reason, the intermediary transfer belt 101 put in a usable state can be used continuously, so that it becomes possible to suppress an increase in running cost. Further, according to this embodiment, on the apparatus main assembly 2 side, the exchange of the belt cleaning device 108 to the new one can be automatically detected, and therefore, a particular operation such that the operator himself (herself) inputs information indicating that the belt cleaning device 108 was exchanged to the new one is not required. For that reason, it becomes possible to suppress that the initial control is not properly carried out due to that the operator forgets input of the information. Further, it becomes possible to reduce time and labor required for maintenance.

Embodiment 2

Next, another embodiment of the present invention will be described. Basic constitution and operation of an image forming apparatus of this embodiment are the same as those of the image forming apparatus in the embodiment 1. Accordingly, elements having identical or corresponding functions or constitutions to those of the image forming apparatus of the embodiment 1 are represented by the same reference numerals or symbols as those in the embodiment 1 and will be omitted from detailed description.

In this embodiment, the number of times of exchange of the belt cleaning device 108 is recorded, and is utilized for notifying (displaying or the like) information prompting exchange of the intermediary transfer belt 101.

That is, in this embodiment, similarly as the embodiment 1, in the intermediary transfer belt unit 100, the lifetime of the belt cleaning device 108 is shorter than the lifetime of the intermediary transfer belt 101. For that reason, in the intermediary transfer belt unit 100, the exchange of only the belt cleaning device 108 is performed in some cases. In this embodiment, similarly as the embodiment 1, the lifetime of the intermediary transfer belt 101 is shorter than the lifetime of the apparatus main assembly 2. For that reason, the exchange of the intermediary transfer belt 101 is also needed.

At this time, in this embodiment, the apparatus main assembly 2 is provided with a storing portion for storing the number of times (of exchange of the belt cleaning device 108 to the new one) of detection of the new belt cleaning device 108. Then, on the basis of the number of times of the exchange of the belt cleaning device 108 to the new one, the information on an exchange timing of the intermediary transfer belt 101 is provided (notified) to the operator. For example, in the case where the number of times of the exchange of the belt cleaning device 108 to the new one reaches a predetermined number of times set in advance, at the operating portion 60 (or a display portion of the external device), information prompting the operator to exchange the intermediary transfer belt 101 can be notified (displayed).

For example, in this embodiment, an index of the lifetime of the intermediary transfer belt 101 is set at 500,000 sheets in terms of the number of sheets printed, and an index of the lifetime of the belt cleaning device 108 is set at 200,000 sheets in terms of the number of sheets printed. In this case, in the case where the number of times of the exchange of the belt cleaning device 108 to the new one reaches two (times) which is an integer which does not exceed 50/20=2.5, the information on the exchange timing of the intermediary transfer belt 101 can be provided (notified) to the operator. For example, at the operating portion 60 or the like, a message that "recommend that intermediary transfer belt is exchanged simultaneously with belt cleaning device when belt cleaning device is exchanged next time at the latest" or the like can be displayed. This is display can be made, for example, at a display screen of a count value of the cleaning counter 71 or a count value of the belt counter 72 or at a screen for guiding an exchange procedure of the belt cleaning device 108. By this, the operator is also capable of exchanging the intermediary transfer belt 101 simultaneously with the belt cleaning device 108 at the time of third exchange of the belt cleaning device 108 at the latest.

Incidentally, the exchange timing of the intermediary transfer belt 101 is not limited to the above-described example. It is assumed that setting of the index of the lifetime of the intermediary transfer belt 101 is a period corresponding to N1 sheets in terms of the number of sheets printed, and setting of the index of the lifetime of the belt cleaning device 108 is a period corresponding to N2 sheets (N1>N2). At this time, the exchange timing of the intermediary transfer belt 101 can be set at a timing when the number of times of the exchange of the belt cleaning device 108 to the new one reaches an integral number (of times) which does not exceed N1/N2 and later. In accordance with the above-described example, the exchange timing may only be required to be set at a timing (for example, second, third or the like) when the number of the exchange of the belt cleaning device 108 to the new one reaches a second time which is an integer which does not exceed 2.5, and latter (timing). This exchange timing of the intermediary transfer belt 101 can be appropriately set depending on a use (operation) environment of the image forming apparatus 1, a status of a print image, or the like. However, this exchange timing is, typically a timing on or after the number of times of the exchange of the belt cleaning device 108 to the new one reaches the integral number (of times) which does not exceed N1/N2 and before the number of times of the exchange reaches the number (of times) which is obtained by adding one to the number (of times) which does not exceed N1/N2.

Figure 8:
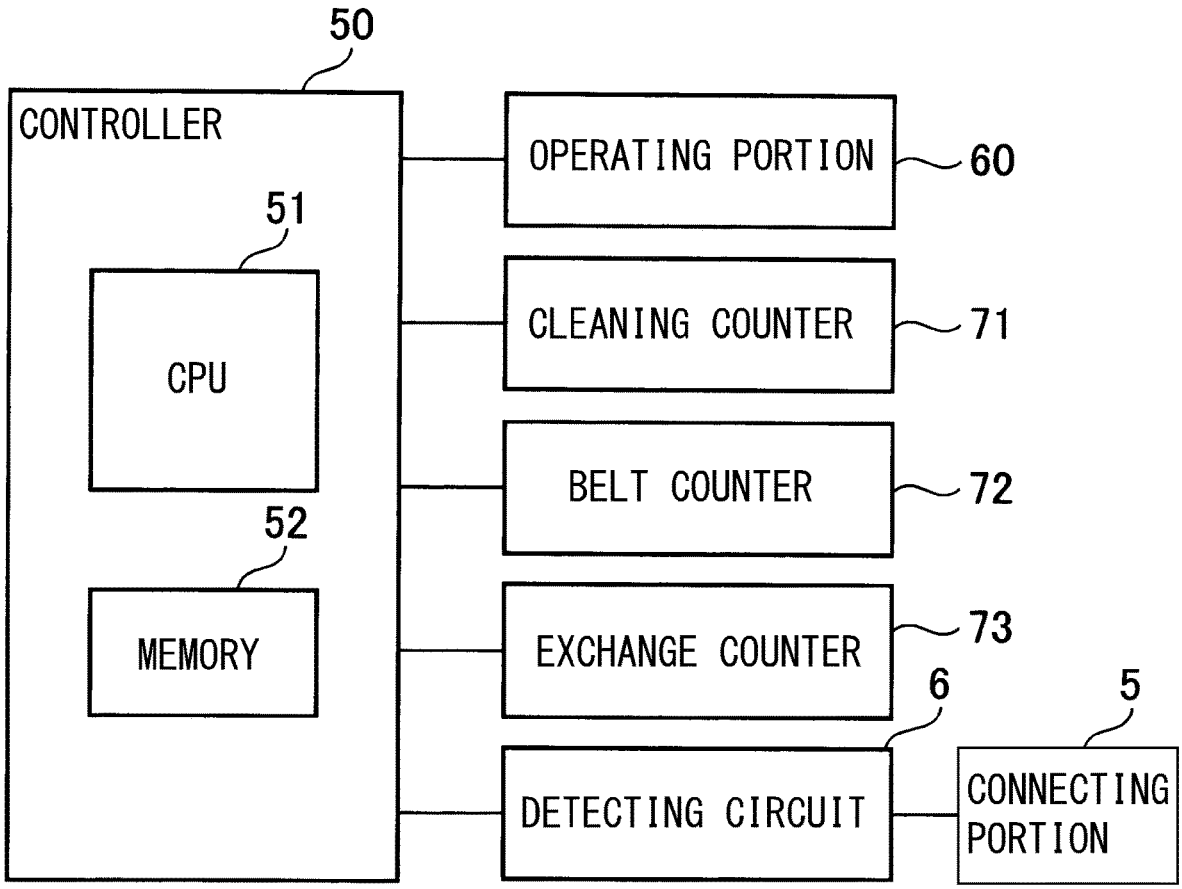
FIG. 8 is a block diagram showing a control mode of a principal part of an image forming apparatus in another embodiment.

FIG. 8 is a schematic block diagram showing a control mode of a principal part of the image forming apparatus 1 of this embodiment. The control mode in this embodiment shown in FIG. 8 is substantially similar to the control mode in the embodiment 1 shown in FIG. 6. However, in this embodiment, to the controller 50, an exchange counter 73, which is a storing portion for storing the number of times (of the exchange of the belt cleaning device 108 to the new one) of detection of the new belt cleaning device 108, is connected. Similarly, as in the case of the counter described in the embodiment 1, the controller 50 causes the exchange counter 73 to renew (add) and store a count value (the number of times of exchange) therein every time the new belt cleaning device 108 is detected. Further, when the intermediary transfer belt 101 is exchanged to the new one, the controller 50 resets the count value (the number of times of exchange) of the exchange counter 73 to an initial value (zero in this embodiment).

Figure 9:
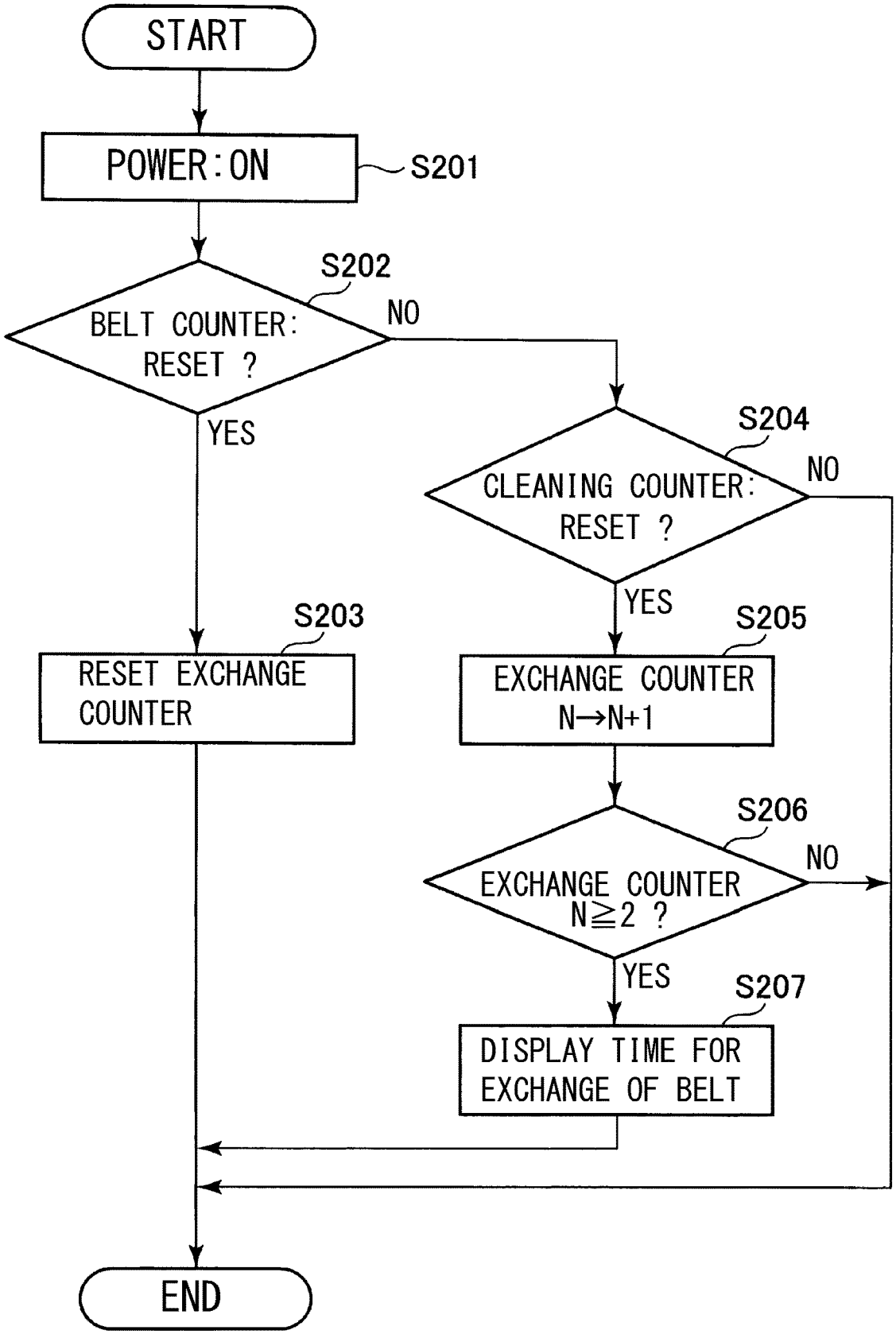
FIG. 9 is a flowchart showing a process of notifying a timing of exchange of an intermediary transfer belt.

FIG. 9 is a flowchart showing an outline of a procedure of processing of notifying an exchange timing of the intermediary transfer belt 101 in this embodiment. In this embodiment, as in the above-described example, at the timing on or after the number of times of the exchange of the belt cleaning device 108 to the new one reaches two (times)

display prompting the operator to exchange the intermediary transfer belt 101 in conformity to the third exchange of the belt cleaning device 108 is made at the operating portion 60.

When the power source of the image forming apparatus 1 is turned on after for example, extraction and insertion of the intermediary transfer belt unit 100 relative to the apparatus main assembly 2 are performed (S201), the controller 50 discriminates whether or not the belt counter 72 is reset to the initial value (S202). That is, the controller 50 discriminates whether or not the intermediary transfer belt 101 is exchanged to the new one. In the case where the controller 50 discriminated in S202 that the belt counter 72 is reset to the initial value (that the intermediary transfer belt 101 was exchanged to the new one), the controller 50 resets the count value of the exchange counter 73 to the initial value (S203).

Further, in the case where the controller 50 discriminated in S202 that the belt counter is not reset to the initial value (that the intermediary transfer belt 101 was not exchanged to the new one), the controller 50 discriminates whether or not the cleaning counter 71 is reset to the initial value (S204). That is, the controller 50 discriminates whether or not the belt cleaning device 108 was exchanged to the new one. Then, in the case where the controller 50 discriminated in S204 that the cleaning counter 71 is reset to the initial value (that the belt cleaning device 108 was exchanged to the new one), the controller 50 adds 1 to the count value of the exchange counter 73 (S205). Then, the controller 50 discriminates whether or not the count value of the exchange counter 73 reaches two (times) (S206). Then, in the case where the controller 50 discriminated in S206 that the count value of the exchange counter 73 reaches two (times), the controller 50 controls the operating portion 60 so as to perform display prompting the operator to exchange the intermediary transfer belt 101 (S207). For example, as described above, on the display screen of the count value of the cleaning counter 71, the message that "recommend that intermediary transfer belt is exchanged simultaneously with belt cleaning device when belt cleaning device is exchanged next time at the latest" or the like can be displayed. On the other hand, in the case where the controller 50 discriminated in S204 that the cleaning counter 71 is not reset (that the belt cleaning device 108 was not exchanged to the remove), the controller 50 ends the processing. Further, in the case where the controller 50 discriminated in S206 that the count value of the exchange counter 73 does not reach two (times), the controller 50 ends the processing.

As described above, according to this embodiment, by utilizing a constitution in which the lifetime of the belt cleaning device 108 relatively short in those of the members in the intermediary transfer belt unit 100, it becomes possible to notify the operator of the exchange timing of the intermediary transfer belt 101 relatively long in lifetime.

Embodiment 3

Next, another embodiment of the present invention will be described. Basic constitution and operation of an image forming apparatus of this embodiment are the same as those of the image forming apparatuses in the embodiments 1 and 2. Accordingly, elements having identical or corresponding functions or constitutions to those of the image forming apparatuses of the embodiments 1 and 2 are represented by the same reference numerals or symbols as those in the embodiments 1 and 2 and will be omitted from detailed description.

In this embodiment, similarly as the embodiments 1 and 2, in the intermediary transfer belt unit 100, the lifetime of the belt cleaning device 108 is shorter than the lifetime of the intermediary transfer belt 101. For that reason, in the intermediary transfer belt unit 100, the exchange of only the belt cleaning device 108 is performed in some cases.

Further, in this embodiment, the tension roller 105 which is a tension roller for imparting predetermined tension to the intermediary transfer belt 101 has a function of a steering roller for moving the intermediary transfer belt 101 in a widthwise direction (direction substantially perpendicular to the surface movement direction of the intermediary transfer belt 101). That is, in this embodiment, the tension roller 105 is included in a steering unit 110 (FIG. 10) as a steering mechanism for correcting a "shift" such that the intermediary transfer belt 101 moves toward either one of opposite end portion sides with respect to the widthwise direction of the intermediary transfer belt 101.

<Steering Unit>

Figure 10:
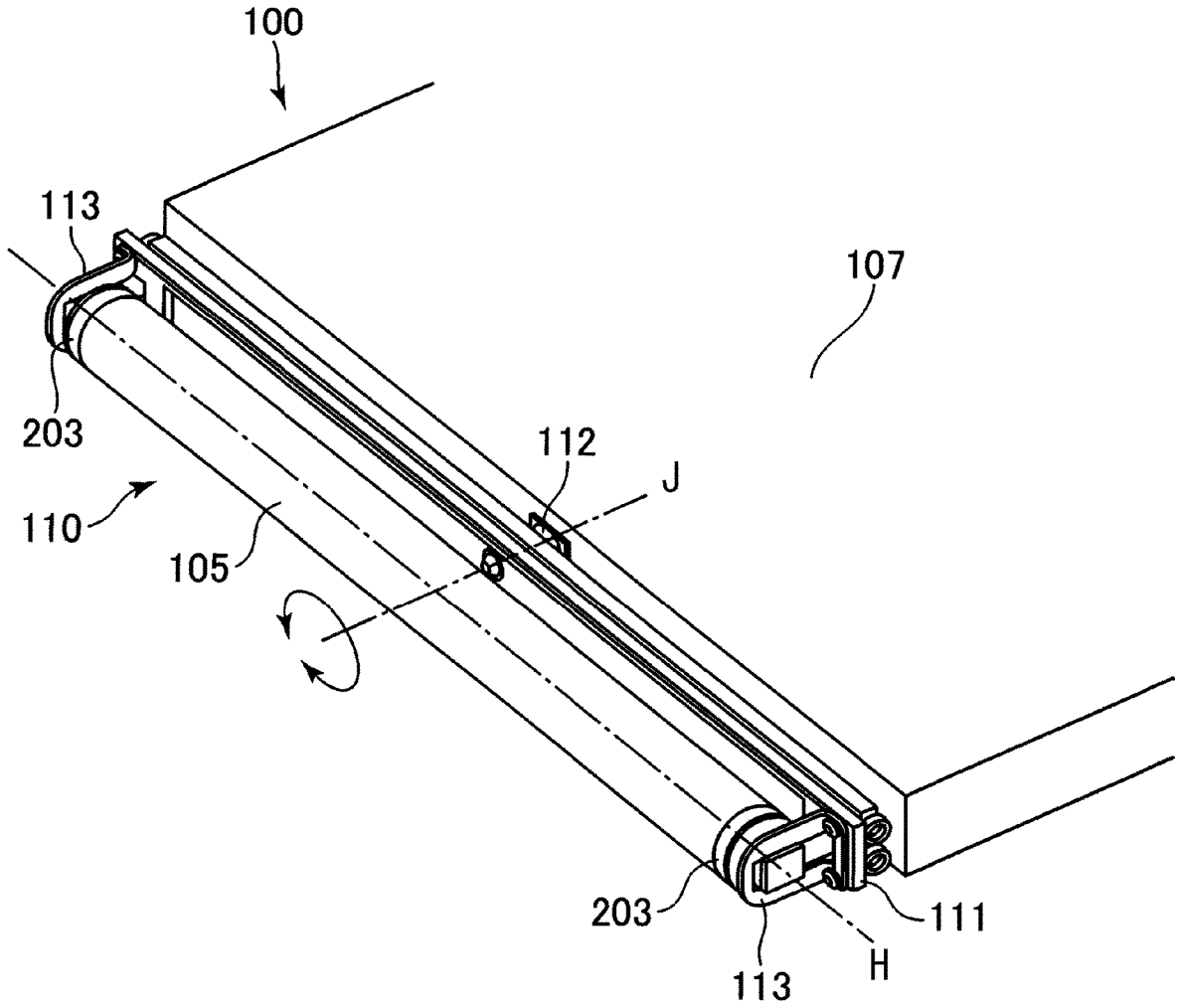
FIG. 10 is a schematic perspective view for illustrating an automatic center alignment control.
Figure 11:
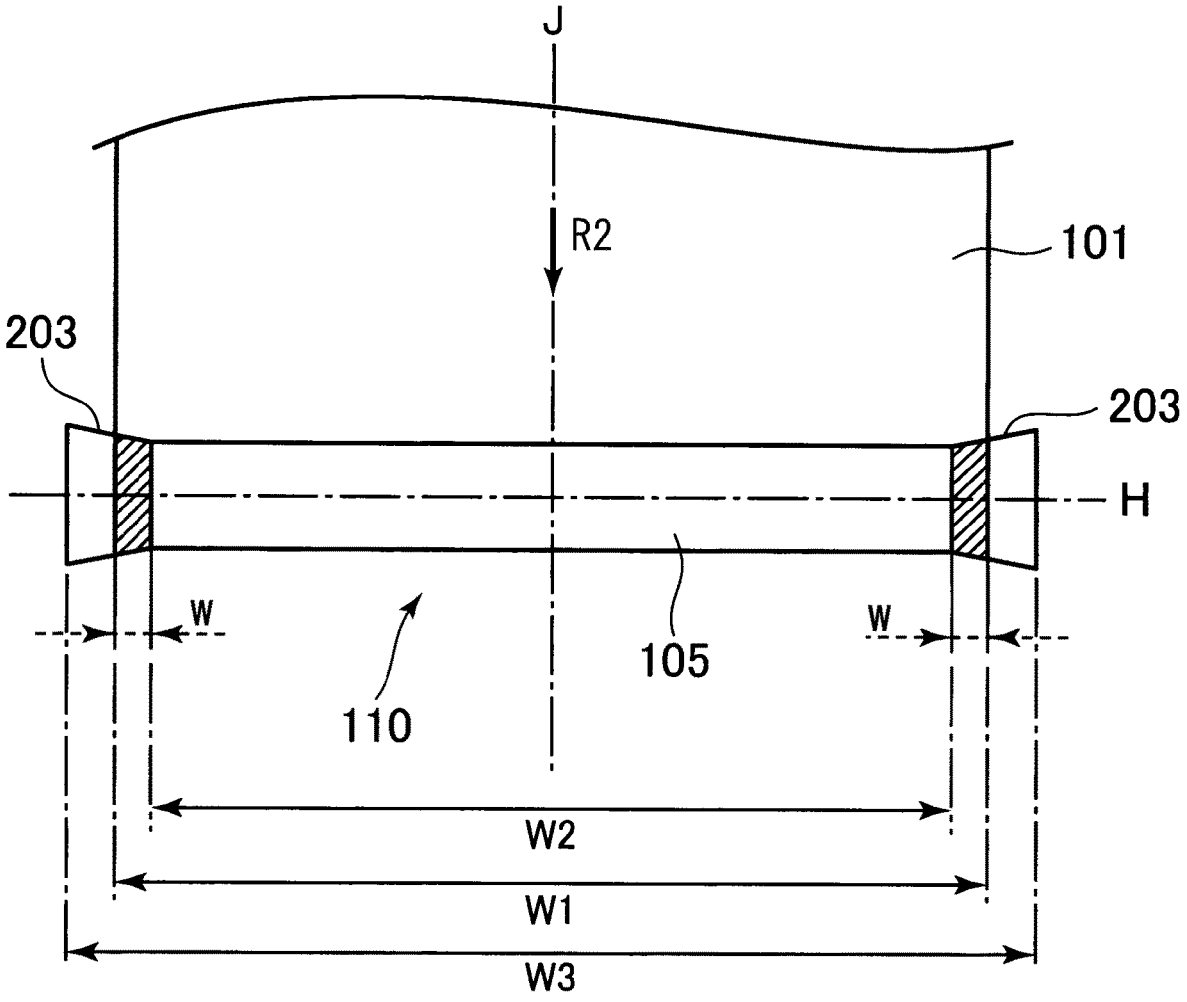
FIG. 11 is a schematic view for illustrating a relationship between the intermediary transfer belt and a slidable ring portion.

FIG. 10 is a schematic perspective view showing an automatic center alignment constitution of the intermediary transfer belt 101 in this embodiment, in which the intermediary transfer belt 101 is omitted from illustration. FIG. 11 is a schematic view for illustrating a relationship between the intermediary transfer belt 101 and slidable ring portions 203 constituting the steering unit 110.

As shown in FIG. 10, the steering unit 110 is constituted by including a steering frame 111, a steering shaft portion 112, bearing portions 113, the slidable ring portions 203, and the tension roller 105 and the like. The steering frame 111 extends along a rotational direction H of the tension roller 105 and is provided with the bearing portions 113 at opposite end portions thereof with respect to the longitudinal direction. The tension roller 105 is rotatably supported by the bearing portions 113 at opposite end portions thereof with respect to the rotational axis direction H. Incidentally, at each of the opposite end portions 113 of the tension roller 105 with respect to the rotational axis direction H, an urging means constituted by a compression spring or the like for urging the tension roller 105 from an inner peripheral surface side toward an outer peripheral surface side of the intermediary transfer belt 101 is provided. The steering shaft portion 112 is provided at a central portion with respect to the rotational axis direction H of the tension roller 105. The steering shaft portion 112 extends along a direction substantially perpendicular to the rotational axis direction H and is supported rotatably (swingably) by the steering frame 111 at one end portion thereof and by the unit frame 107 at the other end portion thereof. By this, an entirety of the steering unit 110 including the steering frame 111 and the tension roller 105 supported by the steering frame 111 is rotatable (swingable) about a swing axis J. The swing axis J passes through an approximate center of the steering axis portion 112 and is substantially perpendicular to the rotational axis direction H of the tension roller 105.

The tension roller 105 follows and rotates together with the intermediary transfer belt 101 in a state in which the tension roller 105 is supported swingably by the steering frame 111. Further, at the opposite end portions of the tension roller 105 with respect to the rotational axis direction, the slidable ring portions 203 as fixing members larger in frictional resistance against the intermediary transfer belt 101 than the tension roller 105 are provided. The slidable ring portions 203 are fixed to the bearing portions 113 so as not to rotate in a manner such that the tension roller 105 and the slidable ring portions 203 are coaxially connected to each other. The tension roller 105 follows the intermediary transfer belt 101 when the intermediary transfer belt 101 rotates, and therefore, does not rub the inner peripheral surface of the intermediary transfer belt 101. On the other hand, the slidable ring portions 203 are fixedly disposed so as not to rotate, and therefore, when the intermediary transfer belt 101 rotates, the slidable ring portions 203 slide on the inner peripheral surface of the intermediary transfer belt 101. Then, when a region where the slidable ring portions 203 and the intermediary transfer belt 101 are in contact with each other is not less than a predetermined amount, the steering unit 110 starts steering, so that automatic center alignment of the intermediary transfer belt 101 is enabled.

Incidentally, the slidable ring portions 203 may also have a constitution in which the slidable ring portions 203 are rotatably supported. However, in that case, a torque necessary to rotate the slidable ring portions 203 in a rotational direction of the intermediary transfer belt 101 is required to be larger than a torque necessary to rotate the tension roller in the same direction. By this, the steering becomes possible. Further, in this embodiment, the slidable ring portions 203 provided at the opposite end portions of the tension roller 105 with respect to the rotational axis direction have a taper shape such that an outer peripheral surface of each of the slidable ring portions 203 is increased in diameter from a central side toward an outside of the tension roller 105 with respect to the rotational axis direction. However, each of the slidable ring portions 203 may also have a cylindrical shape such that an outer diameter thereof is substantially uniform.

Description will be further made with reference to FIG. 11. In this embodiment, with respect to the rotational axis direction of the tension roller 105, a width W1 of the intermediary transfer belt 101 is set so as to be broader than a width W2 of the tension roller 105 and so as to be narrower than a width W3 between outside ends of the slidable ring portions 203 provided at the opposite end portions of the tension roller 105. When the intermediary transfer belt 101 is in an ideal stationary center alignment state, an engaging width w of the intermediary transfer belt 101 with each of the slidable ring portions 203 at the opposite end portions of the tension roller 105 is the same. When the width of the intermediary transfer belt 101 is in the above-described relationship, even if the shift of the intermediary transfer belt 101 occurs, the intermediary transfer belt 101 always slides on either one of the slidable ring portions 203 with an engaging width. That is, this state is a state such that during rotation of the intermediary transfer belt 101 (during the image forming operation), the intermediary transfer belt 101 always slides on one or both of the slidable ring portions 203. In this state, when the intermediary transfer belt 101 moves in the widthwise direction, the tension roller 105 is rotated (swung) by a difference of a frictional force generated depending on the engaging width of the intermediary transfer belt 101 with each of the slidable ring portions 203. Further, the automatic center alignment is performed so as to return the state of the intermediary transfer belt 101 to the above-described ideal stationary center alignment state. Thus, in this embodiment, the steering unit 110 swings about the swing axis J depending on a balance of the frictional force and carries out the automatic center alignment of the intermediary transfer belt 101.

<Portion-to-be-Detected and Connecting Portion>

Figure 12:
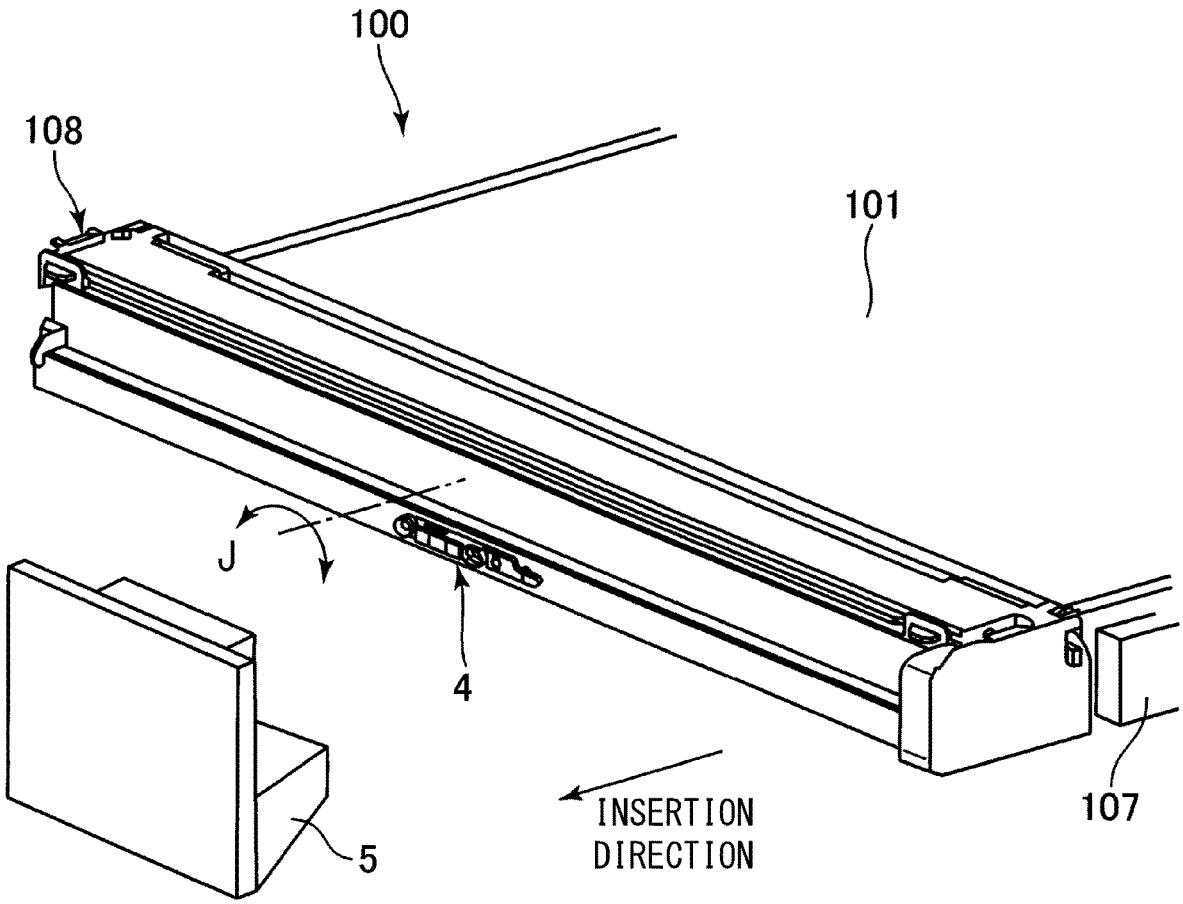
FIG. 12 is a schematic perspective view showing a belt cleaning device and a connecting portion in an embodiment 3.

FIG. 12 is a schematic perspective view showing the belt cleaning device 108 and the connecting portion 5 in this embodiment and shows a state in which the intermediary transfer belt unit 100 to which the belt cleaning device 108 is mounted is being inserted into the apparatus main assembly 2. Parts (a) and (b) of FIG. 13 and FIG. 14 are perspective views each for illustrating a movable portion-to-be-detected 4 in this embodiment. FIG. 15 is a schematic perspective view of the connecting portion 5 fixed in the apparatus main assembly 2 in this embodiment. FIG. 16 is a side view for illustrating the portion-to-be-detected 4 in this embodiment and shows a state in which the belt cleaning device 108 is inclined in a process in which the intermediary transfer belt unit 100 is mounted into the apparatus main assembly 2. FIG. 17 is a perspective view for illustrating an operation of the portion-to-be-detected 4 in this embodiment and shows a state of the fuse holder 4*b* of the portion-to-be-detected 4 and the connecting portion 5 when the intermediary transfer belt unit 100 is in a position immediately before a mounting position thereof. Further, FIG. 18 is a side view for illustrating the operation of the portion-to-be-detected 4 in this embodiment and shows the state of the fuse holder 4*b* of the portion-to-be-detected 4 and the connecting portion 5 when the intermediary transfer belt unit 100 is in the position immediately before the mounting position thereof.

As shown in FIG. 12, the belt cleaning device 108 is positioned relative to the steering unit 110 (specifically the steering frame 111 (FIG. 10)) and is mounted to the intermediary transfer belt unit 100. For that reason, the belt cleaning device 108 is supported so as to be swingable integrally with the steering unit 110 (the tension roller 105). Further, in this embodiment, the belt cleaning device 108 includes the fuse holder 4*b* as a supporting member for supporting the fuse substrate 4*a* so as to be movable relative to the belt cleaning device 108 in a flat plane including, as a normal line, the above-described swing axis J.

Part (a) of FIG. 13 shows a state in which a side surface of the portion-to-be-detected 4 in a state that the portion-to-be-detected 4 is dismounted from the cleaning container 184 of the belt cleaning device 108 and a side surface of the cleaning container 184 are viewed from a downstream side of an inserting direction of the intermediary transfer belt unit 100 into the apparatus main assembly 2. Further, part (b) of FIG. 13 shows a state in which the fuse holder 4*b* of the portion-to-be-detected 4 is viewed from a side-surface side where the fuse holder 4*b* is to be disposed along a side surface of the cleaning container 184. As shown in parts (a) and (b) of FIG. 13, in this embodiment, on the side surface of the fuse holder 4*b* on the cleaning container 184 side, a mounting projection 4*g* as a mounting portion is provided. In this embodiment, the mounting projection 4*g* is formed integrally with the fuse holder 4*b*. The mounting projection 4*g* is provided closer to one end portion (rear-side end portion) than to a central portion with respect to a longitudinal direction of the fuse holder 4*b* disposed along a longitudinal direction of the cleaning container 184. The mounting projection 4*g* includes a shaft portion 4*g*1 extending toward the cleaning container 184 side along the swing axis J and includes a retaining portion 4*g*2 which is provided at an end of the shaft portion 4*g*1 and which extends in a direction crossing (in this embodiment, substantially perpendicular to) an axial direction of the shaft portion 4*g*1. The mounting projection 4*g* is supported by the cleaning container 184 in a manner such that the shaft portion 4*g*1 is engaged in a supporting hole 184*g* as a supporting portion provided in the cleaning container 184 with a gap and that the retaining portion 4*g*2 is retained by being engaged with an edge portion of the supporting hole 184*g*.

Further, as shown in parts (a) and (b) of FIG. 13, in this embodiment, on the side surface of the fuse holder 4*b* on the cleaning container 184 side, a restricting projected portion (projection-shaped portion) 4*f* as a restricting receiving portion is provided. In this embodiment, the restricting projected portion 4*f* is formed integrally with the fuse holder 4*b* is formed integrally with the fuse holder 4*b*. The restricting projected portion 4*f* is provided closer to an end portion (front-side end portion) on a side opposite from a side where the above-described mounting projection 4*g* is provided, than to the central portion with respect to the longitudinal direction of the fuse holder 4*b* disposed along the longitudinal direction of the cleaning container 184. The restricting projected portion 4*f* extends toward the cleaning container 184 side along the swing axis J. The restricting projected portion 4*f* is engaged in a restricting hole 184*f* as a restricting portion provided in the cleaning container 184 with a gap.

In this embodiment, the fuse holder 4*b* is disposed in the neighborhood of the central portion of the cleaning container 184 with respect to the longitudinal direction. Specifically, the fuse holder 4*b* is disposed at a position such that with respect to the longitudinal direction (the rotational axis direction of the tension roller 105) of the cleaning container 184, the fuse holder 4*b* crosses the swing axis J and the above-described mounting projection 4*g* is closer to the swing axis J than the restricting projected portion 4*f* is.

By a constitution as described above, the fuse holder 4*b* is held by the belt cleaning device 108 with play (clearance) between itself and the cleaning container 184 in the neighborhood of the swing axis J. For that reason, as shown in FIG. 14, the fuse holder 4*b* is movable up and down, left and right in the case where the fuse holder 4*b* is viewed from the downstream side of the inserting direction of the intermediary transfer belt unit 100 into the apparatus main assembly 2 along the swing axis J. Incidentally, a left-right direction corresponds to the above-described front-rear direction of the apparatus main assembly 2.

Further, as shown in part (a) of FIG. 13 and FIG. 14, the fuse holder 4*b* is provided with through holes 4*e* and 4*e* as positioning receiving portions into which positioning projected portions 5*d* and 5*d* (FIG. 15) of the connecting portion 5 which are described later are inserted, respectively. The through holes 4*e* and 4*e* extend along the inserting direction (direction substantially parallel to the swing axis J) of the intermediary transfer belt unit 100 and penetrate through the fuse holder 4*b*. In this embodiment, with respect to the longitudinal direction of the fuse holder 4*b* disposed along the longitudinal direction of the cleaning container 184, one through hole 4*e* is positioned on a rear side than the mounting projection 4*g*, and the other through hole 4*e* is positioned between the mounting projection 4*g* and the restricting projected portion 4*f*. Further, with respect to the longitudinal direction of the fuse holder 4*b*, the fuse substrate 4*a* is disposed between the two through holes 4*e* and 4*e*. Incidentally, these position receiving portions may also be recessed portions into which the positioning projected portions 5*d* and 5*d* of the connecting portion 5 are inserted, respectively, as described later. In that case, the recessed portions extend along the inserting direction of the intermediary transfer belt unit 100 into the apparatus main assembly 2 and are formed so as to open toward a is downstream side of the inserting direction. Further, in this embodiment, on the fuse holder 4*b*, inclined surfaces 4*d* and 4*d* as guiding portions positioned at edge portions of the through holes 4*e* and 4*e*, respectively, at the side surface thereof on a side opposite from the cleaning container 184 side. In a process in which the intermediary transfer belt unit 100 is mounted into the apparatus main assembly 2, the positioning projected portions 5*d* and 5*d* of the connecting portion 5 can be guided to the through holes 4*e* and 4*e*, respectively. In this embodiment, each of these inclined surfaces 4*d* and 4*d* is formed in substantially conical shape such that a diameter thereof increases from an upstream side toward a downstream side with respect to the inserting direction of the intermediary transfer belt unit 100 into the apparatus main assembly 2. Incidentally, each of the inclined surfaces may also have a substantially pyramid shape (for example, quadrangular pyramid shape) or the like having sides (flat surfaces). Further, each of the inclined surfaces may also have a conical shape including a curved surface and a flat surface.

On the other hand, the apparatus main assembly 2 includes an engaging member engageable with the fuse holder 4*b* therein. In this embodiment, as shown in FIG. 15, on a side surface of the connecting portion 5, on the belt cleaning device 108 side, fixed to the apparatus main assembly 2, the above-described positioning projected portions (projection-shaped portions) 5*d* and 5*d* as positioning portions constituting the above-described engaging portions are provided. The positioning projected portions 5*d* and 5*d* extend toward the belt cleaning device 108 side along the inserting direction of the intermediary transfer belt unit 100 into the apparatus main assembly 2. In this embodiment, the positioning projected portions 5*d* and 5*d* having the substantially cylindrical shape include chambered portions (chamfer-shaped portions) 5*c* and 5*c*, respectively, as guiding receiving portions contactable to the above-described inclined surfaces 4*e* and 4*e*, respectively, at free end portions thereof. Each of these guiding receiving portions may also be a semi-spherical surface. Further, with respect to the front-rear direction (direction substantially parallel to the longitudinal direction of the cleaning container 184) of the apparatus main assembly 2, the contact springs 5*a* and 5*a* are disposed between the two positioning projected portions 5*d* and 5*d*. The contact springs 5*a* and 5*a* are connected to the detecting circuit 6 (FIG. 6) provided in the apparatus main assembly 2 via an electrical bundle line 6*a* provided in the apparatus main assembly 2.

<Operation During Mounting>

An operation of the steering unit 110 and the belt cleaning device 108 when the intermediary transfer belt unit 100 to which the belt cleaning device 108 is mounted is mounted in the apparatus main assembly 2 will be described.

As shown in FIG. 12, in a process in which the intermediary transfer belt unit 100 is mounted into the apparatus main assembly 2, the intermediary transfer belt unit 100 moves toward the mounting position while the unit frame 107 is restricted in attitude by rails (not shown) provided in the apparatus main assembly 2. On the other hand, the belt cleaning device 108 and the steering unit 110 are swingable about the swing axis J relative to the unit frame 107 and the apparatus main assembly 2. Further, the fuse holder 4*b* is supported movably up and down, left and right relative to the belt cleaning device 108. The intermediary transfer belt unit 100 is inserted into the apparatus main assembly 2 toward the mounting position while the belt cleaning device 108 and the steering unit 110 are in a swingable state and while the fuse holder 4*b* is in a movable state. For that reason, it is assumed that an attitude of the fuse holder 4*b* relative to the connecting portion 5 fixed to the apparatus main assembly 2 immediately before the intermediary transfer belt unit 100 reaches the mounting position is different every mounting operation of the intermediary transfer belt unit 100 into the apparatus main assembly 2. For example, as shown in FIG. 16, a state in which the steering unit 110 and the belt cleaning device 108 are each inclined so that one end (on the right side in the figure) is lower than the other end (on the left side in the figure) with respect to a vertical direction can be formed. Further, a state in which the fuse holder 4*b* is further inclined relative to the steering unit 110 and the belt cleaning device 108 can be formed.

In this embodiment, in consideration of a positional fluctuation factor, setting is made so that the inclined surfaces 4*d* and 4*d* of the fuse holder 4*b* always contact the chamfered portions 5*c* and 5*c*, respectively, of the connecting portion 5. This positional fluctuation factor includes the following. First, the factor includes variations of respective component parts. Further, the factor includes maximum swing amounts (±1.5° about the swing axis J) of the steering unit 110 and the belt cleaning device 108. Further, the factor includes a maximum movement amount (±2.6°, ±1.4 mm in left-right direction, ±2.45 mm in up-down direction) of the fuse holder 4*b* relative to the belt cleaning device 108.

That is, as shown in FIG. 17, in a state in which the intermediary transfer belt unit 100 reaches a position immediately before the mounting position, axes of the positioning projected portions 5*d* and 5*d* of the connecting portion 5 are in positions projected on the inclined surfaces 4*d* and 4*d* of the fuse holder 4*b* which start to contact the chamfered portions 5*c* and 5*c*, respectively, of the connecting portion 5. The fuse holder 4*b* receives a force from the chambered portions 5*c* and 5*c* at the inclined surfaces 4*d* and 4*d*, respectively, thereof and moves so as to follow the positioning projected portions 5*d* and 5*d*. By this, the fuse holder 4*b* moves so as to rotate in an arrow I direction in FIG. 18, and changes in attitude to a substantially horizontal direction. When the intermediary transfer belt unit 100 is inserted toward the mounting direction as it is, the intermediary transfer belt unit 100 finally reaches the mounting position, and the through holes of the fuse holder 4*b* and the positioning projected portions 5*d* and 5*d* of the connecting portion 5 engage with each other, so that the fuse holder 4*b* is positioned. As a result, energization to the fuse substrate 4*a* via the connecting portion 15 is enabled, so that it becomes possible to discriminate whether or not the belt cleaning device 108 is exchanged to the new one, by the operation similar to the operations in the embodiments 1 and 2.

<Operation during Rotation of Intermediary Transfer Belt>

Next, operations of the steering unit 110 and the belt cleaning device 108 during rotation of the intermediary transfer belt 101 (during the image forming operation) will be described.

In a state in which the fuse holder 4*b* and the connecting portion 5 and engaged with each other in the apparatus main assembly 2, rotation of the intermediary transfer belt 1 (image forming operation) is carried out. Depending on the image to be formed, a kind of the recording material P (paper kind), alignment of a rotation shaft of the stretching roller in the intermediary transfer belt unit 100, or the like, there is a possibility that the shift (movement in the widthwise direction) of the intermediary transfer belt 101 occurs during the rotation of the intermediary transfer belt 101. In this embodiment, the intermediary transfer belt 101 is continuously rotated (i.e., the image forming operation is continued) while the shift thereof is corrected by the steering unit 110 as described above. Here, in this embodiment, as described above, the belt cleaning device 108 is swung integrally with the steering unit 110. Further, in this embodiment, the fuse holder 4*b* is supported movably up and down, left and right with play relative to the belt cleaning device 108. For that reason, the fuse holder 4*b* is freely movable in a flat plane including the swing axis J as a normal line even when the fuse holder 4*b* is still engaged with the connecting portion 5 fixed in the apparatus main assembly 2, and thus does not impair the center alignment of the intermediary transfer belt 101 due to the steering operation. Incidentally, different from this embodiment, when a constitution in which the connecting portion 5 is swung with the swung of the steering unit 110 is employed, there is the following possibility. That is, the connecting portion 5 swings together with the electrical bundle line and the electrical contacts, so that there is a possibility that the center alignment of the intermediary transfer belt 101 becomes insufficient due to a load of the steering and causes image defect and that improper conduction occurs due to breakage of the electrical bundle line or abrasion of the electrical contacts.

As described above, according to this embodiment, an effect similar to the effects of the embodiments 1 and 2 can be obtained. Further, according to this embodiment, in a constitution in which the belt cleaning device 108 is swingable, irrespective of the attitude of the belt cleaning device 108 when the intermediary transfer belt unit 100 is mounted in the apparatus main assembly 2, it becomes possible to establish good connection between the fuse substrate 4*a* and the connecting portion 5. Further, according to this embodiment, in the constitution in which the belt cleaning device 108 is swingable, it is possible to suppress that the connection between the fuse substrate 4*a* and the connecting portion 5 has the influence on the swing of the belt cleaning device 108 during the rotation of the intermediary transfer belt 101.

Incidentally, in this embodiment, the mounting projection 4*g* and the restricting projected portion 4*f* are formed integrally with the fuse holder 4*b*, but the present invention is not limited to such an embodiment. For example, a constitution in which a stepped screw (stepped bolt) retained by the cleaning container with play with respect to a radial direction is used as each of the mounting portion and the restricting receiving portion and is fixed to the supporting member may also be employed. Also, by such a constitution, similarly as in this embodiment, the supporting member is movable up and down, and left and right, so that an effect similar to the effect of this embodiment can be obtained.

Further, in this embodiment, the case where the steering mechanism has the automatic center alignment constitution by the difference in frictional force with the intermediary transfer belt was described as an example, but the present invention is not limited to such a constitution. The steering mechanism may also have a constitution in which the stretching roller is swung by power of a motor or the like and thus the center alignment of the intermediary transfer belt is carried out. Further, a swing shaft (tilting shaft) of the swingable (tiltable) stretching roller is not limited to one positioned at a substantially central portion with respect to the widthwise direction of the intermediary transfer belt, but may also be positioned at an end portion. In that case, in the neighborhood of the swing shaft of the steering unit, it is possible to dispose the swing shaft of the supporting member of the portion-to-be-detected and the connecting portion of the apparatus main assembly. By this, an effect similar to the effect of the present invention can be obtained.

Embodiment 4

Next, another embodiment of the present invention will be described. Basic constitution and operation of an image forming apparatus of this embodiment are the same as those of the image forming apparatus in the embodiment 1. Accordingly, elements having identical or corresponding functions or constitutions to those of the image forming apparatus of the embodiment 1 are represented by the same reference numerals or symbols as those in the embodiment 1 and will be omitted from detailed description.

In the above-described embodiments, the belt cleaning device 108 was provided with the fuse substrate. In this embodiment, the belt cleaning device 108 is provided with a memory substrate 93 (FIG. 19) constituting a memory capable of storing information. To this memory substrate 93, information capable of being used for discriminating whether or not the belt cleaning device 108 is the new one is written.

FIG. 19 is a schematic block diagram showing a control mode of a principal part of the image forming apparatus 1 of this embodiment. The control mode in this embodiment shown in FIG. 19 is substantially similar to the control mode in the embodiment 1 shown in FIG. 6. However, in this embodiment, to the controller 50, a reading/writing circuit 91 as a reading/writing portion capable of reading information from the memory substrate 93 provided on the belt cleaning device 108 and of writing information to the memory substrate 93 is connected. To the reading/writing circuit 91, a connecting portion 92 electrically connectable to the memory substrate 93 is connected. The reading/writing circuit 91 inputs, to the controller 50, the information read from the memory substrate 93 via the connecting portion 92. Further, the reading/writing circuit 91 writes the information to the memory substrate 93 via the connecting portion 92 by the control of the controller 50. On the basis of the information (including no predetermined information) from the memory substrate 93, the controller 50 is capable of detecting whether or not the belt cleaning device 108 is the new one.

The memory substrate 93 may be supported by a memory holder 94 as a supporting member corresponding to the fuse holder 4*a* described in the above-described embodiments. Further, by connection of the electrical contact portions of the memory substrate 93 and the electrical contact portions provided on the connecting portion 92 corresponding to the connecting portion 5 described in the above-described embodiments, reading and writing of the information relative to the memory substrate 93 by the reading/writing circuit 91 are enabled. Incidentally, each of the memory substrate 93 and the connecting portion 92 may also be provided with electrical contact portions in an arbitrary number depending on the constitution of the memory substrate 93.

Particularly, in the case where the belt cleaning device 108 is swingable as described in the embodiment 2, the memory holder 94 can be constituted similarly as the fuse holder 4*a*. By this, similarly as the embodiment 2, in a constitution in which the belt cleaning device 108 is swingable, irrespective of the attitude of the belt cleaning device 108 when the intermediary transfer belt unit 100 is mounted in the apparatus main assembly 2, it becomes possible to establish good connection between the memory substrate 93 and the connecting portion 92. Further, by this, similarly as the embodiment 2, in the constitution in which the belt cleaning device 108 is swingable, it is possible to suppress that the connection between the memory substrate 93 and the connecting portion 92 has the influence on the swing of the belt cleaning device 108 during the rotation of the intermediary transfer belt 101.

The controller 50 is, for example, capable of discriminating whether or not the belt cleaning device 108 is the new one by acquiring predetermined information stored in a predetermined storing area in the memory substrate 93 or by detecting the presence or absence of the predetermined information in the predetermined storing area. For example, the controller 50 is capable of discriminating that the belt cleaning device 108 is the new one by acquiring information from the memory substrate 93 that the belt cleaning device 108 is the new one. In this case, in the case where the use of the belt cleaning device 108 is started, the information may be erased or renewed to information indicating that the belt cleaning device 108 is not the new one. Further, the controller 50 is capable of discriminating that the belt cleaning device 108 is not the new one by acquiring information, from the memory substrate 93, indicating that the belt cleaning device 108 is not the new one (the use of the belt cleaning device 108 is started). In this case, in the case where the use of the belt cleaning device 108 is started, information indicating that the belt cleaning device 108 is not the new one may be written or the information may be rewritten from the information indicating that the belt cleaning device 108 is the new one to the information indicating that the belt cleaning device 108 is not the new one. Further, to the memory substrate 93, for example, identification information of the belt cleaning device 108 such as manufacturing information of the exchange unit (belt cleaning device, intermediary transfer belt unit or the like) may also be written. Such information is written to the memory substrate 93, for example, during manufacturing of the belt cleaning device 108 or during factory shipment. In this case, the controller 50 checks, for example, identification information of the belt cleaning device 108, which is stored in the memory 52 of the controller 50 and which has been used in the image forming apparatus 1 by then, against identification information of a newly mounted belt cleaning device. By this, it is possible to discriminate whether or not the belt cleaning device 108 is the new one.

Incidentally, the constitution in which the belt cleaning device 108 in this embodiment is provided with the memory substrate 93 is also applicable to the case where a memory substrate 93 for storing not only the information for discriminating whether or not the belt cleaning device 108 is the new one but also arbitrary information is provided.

Other Embodiments

As described above, the present invention was described in accordance with the specific embodiments, but the present invention is not limited to the above-described embodiments.

In the above-described embodiments, in the case where the intermediary transfer belt 101 is exchanged to the new one, the controller 50 reset the count value (number of sheets printed) of the belt cleaning counter 71 to the initial value depending on a predetermined operation by the operator at the operating portion 60. On the other hand, for example, in the case where the intermediary transfer belt 101 is exchanged to the new one in the intermediary transfer belt unit 100, the case where the belt cleaning device 108 is also always exchanged to the new one simultaneously therewith would be considered. For example, in such a case, when the controller 50 detects that the belt cleaning device 108 is exchanged to the new one, it is possible to not only reset the cleaning counter 71 to the initial value but also reset the belt counter 72 to the initial value.

Further, in the above-described embodiments, in order to provide (notify) the index of the exchange timing of the belt cleaning device 108 or the like, counting of the index value relating to the use amount of the belt cleaning device 108 by the cleaning counter 71 was carried out. However, the image forming apparatus 1 may only be required to be capable of detecting that the belt cleaning device 108 is exchanged to the new one in the intermediary transfer belt unit 100, and does not need to have a counting function by the cleaning counter 71.

Further, in the above-described embodiments, the case where the cleaning member of the belt cleaning device 108 is the blade (cleaning blade) 181 formed with the electric member was described. However, the present invention is not limited to such a constitution, but when a cleaning member which is required to be exchanged due to abrasion or the like by use and which is shorter in lifetime than the intermediary transfer member in the intermediary transfer member unit is used, an effect similar to those in the above-described embodiments can be obtained by applying the present invention thereto. For example, as the cleaning member, it is possible to cite, in addition to the blade-like member, a brush-like member, a sheet-like member, and the like. However, necessity of the initial control such as the above-described supply control is relatively high or the like, and therefore, it can be said that the effect of the present invention is particularly conspicuous in the case where the cleaning member is the cleaning blade.

Further, in the above-described embodiments, the case where the intermediary transfer member is the endless belt was described. However, the present invention is not limited to such a constitution, and the intermediary transfer member may also be a drum-shaped intermediary transfer member or the like formed by stretching and winding a sheet about a frame.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Application No. 2020-155020 filed on Sep. 15, 2020, and Na 2021-014027 filed on Jan. 29, 2021, which are hereby incorporated by reference herein in their entirety.

What is claimed is:

1. An image forming apparatus comprising:

an image forming portion configured to form a toner image on an image bearing member;

an intermediary transfer unit mountable in and dismountable from a main assembly and including a belt onto which the toner image is transferred from the image bearing member;

a cleaning unit mountable to and dismountable from said intermediary transfer unit and including a cleaning member configured to clean a surface of said belt while in contact with said belt;

a fuse provided on said cleaning unit and configured to be rendered non-conductible by energization; and a detecting portion configured to detect whether or not a current has flowed through said fuse, wherein said intermediary transfer unit includes a stretching roller configured to stretch said belt and a steering unit configured to move said belt in a widthwise direction by swinging said stretching roller about a swing axis crossing a rotational axis of said stretching roller, wherein said cleaning unit is positioned on said steering unit so as to be swingable integrally with said steering unit, wherein said cleaning unit includes a supporting member configured to support said fuse so as to be swingable relative to said cleaning unit about the swing axis, wherein the main assembly includes an engaging member configured to engage with said supporting member therein, and wherein a maximum swing amount of said supporting member relative to said cleaning unit is greater than a maximum swing amount of said steering unit.

2. An image forming apparatus according to claim 1, further comprising a controller configured to control said image forming portion so as to carry out an operation in which, in a case that said detecting portion detects that the current has flowed through said fuse, a predetermined toner image is formed on said belt and is supplied to a contact portion between said cleaning member and said belt.

3. An image forming apparatus according to claim 1, wherein said engaging member includes a projected portion, and wherein said supporting member is provided with a recessed portion or a through-hole into which said projected portion is inserted, and an inclined surface capable of guiding said projected portion into said recessed portion or said through-hole in a process in which said intermediary transfer unit is mounted in said main assembly.

4. An image forming apparatus according to claim 3, wherein said inclined surface is formed in a substantially conical shape.

5. An image forming apparatus according to claim 3, wherein said projected portion includes a chamfered portion contactable to said inclined surface.

6. An image forming apparatus according to claim 1, wherein said steering unit performs center alignment of said belt by being swung about the swing axis by a frictional force between said steering unit and said belt.

7. An image forming apparatus comprising:

an image forming portion configured to form a toner image on an image bearing member;

an intermediary transfer unit mountable in and dismountable from a main assembly and including a belt onto which the toner image is transferred from the image bearing member;

a cleaning unit mountable to and dismountable from said intermediary transfer unit and including a cleaning member configured to clean a surface of said belt while in contact with said belt; and a memory provided on said cleaning unit and configured to store information regarding whether or not said cleaning unit is newly-mounted, wherein said intermediary transfer unit includes a stretching roller configured to stretch said belt and a steering unit configured to move said belt in a widthwise direction by swinging said stretching roller about a swing axis crossing a rotational axis of said stretching roller, wherein said cleaning unit is positioned on said steering unit so as to be swingable integrally with said steering unit, wherein said cleaning unit includes a supporting member configured to support said memory so as to be swingable relative to said cleaning unit about said swing axis, wherein the main assembly includes an engaging member configured to engage with said supporting member therein, and wherein a maximum swing amount of said supporting member relative to said cleaning unit is greater than a maximum swing amount of said steering unit.

8. An image forming apparatus according to claim 2, further comprising:

a counter configured to count an index value regarding a use amount of said cleaning unit from a start of use of said cleaning unit since said cleaning unit was newly-mounted; and a notifying device configured to notify of information upon exchange of said cleaning unit in a case that the value counted by said counter has reached a predetermined value, wherein the counted value of said counter is reset to an initial value in a case that said detecting portion detects that the current has flowed through said fuse.

9. An image forming apparatus according to claim 1, wherein said supporting member is configured to be movable relative to said cleaning unit in a direction crossing the swing axis.

* * * * *